US010605567B1

(12) United States Patent
Hartman et al.

(10) Patent No.: US 10,605,567 B1
(45) Date of Patent: Mar. 31, 2020

(54) SIGHTING DEVICE FOR HANDHELD MORTAR SYSTEM

(71) Applicants: Steven T. Hartman, Churchville, VA (US); Paul Stoneburner, Waynesboro, VA (US)

(72) Inventors: Steven T. Hartman, Churchville, VA (US); Paul Stoneburner, Waynesboro, VA (US)

( * ) Notice: Subject to any disclaimer, the term of this patent is extended or adjusted under 35 U.S.C. 154(b) by 38 days.

(21) Appl. No.: 16/135,921

(22) Filed: Sep. 19, 2018

(51) Int. Cl.
*F41G 1/50* (2006.01)
*F41G 3/06* (2006.01)
*F41F 1/06* (2006.01)

(52) U.S. Cl.
CPC ..... *F41G 1/50* (2013.01); *F41F 1/06* (2013.01); *F41G 3/06* (2013.01)

(58) Field of Classification Search
CPC ..... F41G 1/50; F41F 1/06; F41A 23/54
USPC ..... 89/37.05
See application file for complete search history.

(56) References Cited

U.S. PATENT DOCUMENTS 1,334,413 A * 3/1920 Stokes ..... F41F 1/06 89/1.35
2,202,000 A 5/1940 Gray
2,478,898 A 8/1949 Darr, Jr. et al.
2,560,574 A 7/1951 Herter
2,572,882 A 10/1951 Roberts et al.
2,775,817 A 1/1957 Schuman
2,876,545 A 3/1959 Gabrusti
2,911,723 A 11/1959 Ashbrook
3,256,608 A * 6/1966 Neisius ..... F41G 1/44 33/228
3,424,420 A 1/1969 Seiderman
3,553,843 A 1/1971 Sophinos et al.
3,710,675 A * 1/1973 Asikainen ..... F41F 1/06 89/41.17
4,026,190 A 5/1977 Blair
4,208,801 A 6/1980 Blair
4,214,372 A 7/1980 Rusbach
4,292,880 A 10/1981 Lopez et al.
4,326,847 A 4/1982 Roe
4,427,386 A 1/1984 Fields
(Continued)

OTHER PUBLICATIONS

Tarantola, Andrew, https://gizmodo.com/the-u-s-militarys-mortar-launchers-are-getting-a-21st-1462417134, Nov. 12, 2013, 4 pages.

*Primary Examiner* — Joshua E Freeman
(74) *Attorney, Agent, or Firm* — Daniel L. Fitch, Esq.; Ginger T. Chapman

(57) ABSTRACT

A sighting assembly for a mortar employed in handheld mode. The sighting assembly is attached to the discharge end of a mortar tube by a mounting collar. The collar includes first and second distance indicator dials that employ a pointer to indicate the distance a mortar projectile will travel at different mortar angles and charges. The sighting assembly further includes structure allowing a compass to be locked in a housing by a first cam lever. The entire housing pivots about a cam bolt attached to a second cam lever that can lock the housing in a position parallel to the ground at any angle the mortar is positioned. This will allow a measurement of azimuth to a target to be taken. The azimuth and distance measurements can be used to deliver a mortar projectile to the target while keeping the target in the mortarman's line of sight.

11 Claims, 13 Drawing Sheets

(56) References Cited

U.S. PATENT DOCUMENTS

| | | | | |
|---|---|---|---|---|
| 4,711,180 | A | 12/1987 | Smolnik | |
| 4,961,369 | A | 10/1990 | McGill | |
| 5,228,855 | A | 7/1993 | Frost | |
| 5,406,733 | A | 4/1995 | Tarlton et al. | |
| 5,659,965 | A | 8/1997 | Thibodeau et al. | |
| 5,688,124 | A | 11/1997 | Salzeder | |
| 6,059,573 | A | 5/2000 | Patel | |
| 6,568,092 | B1 | 5/2003 | Brien | |
| 6,568,118 | B1 | 5/2003 | Teetzel | |
| 7,448,306 | B2 | 11/2008 | Shipman et al. | |
| 7,637,198 | B2 | 12/2009 | De Villiers et al. | |
| 7,712,242 | B2 | 5/2010 | Matthews et al. | |
| 7,934,652 | B2 | 5/2011 | Hasselbring | |
| 8,683,732 | B2 | 4/2014 | Joplin | |
| 8,701,331 | B2 | 4/2014 | Schneider et al. | |
| 8,733,011 | B2 | 5/2014 | Spuhr | |
| 8,745,914 | B2 | 6/2014 | Schmidt | |
| 8,794,120 | B2 | 8/2014 | Kohnen et al. | |
| 8,898,949 | B1 | 12/2014 | Greenwood | |
| 9,207,044 | B2 | 12/2015 | Brown | |
| 9,777,996 | B2 | 10/2017 | Spuhr | |
| 2007/0199225 | A1 | 8/2007 | Haugen | |
| 2011/0271578 | A1 | 11/2011 | Karagias | |
| 2012/0024135 | A1* | 2/2012 | Kohnen | F41A 27/22 89/1.3 |
| 2013/0318852 | A1 | 12/2013 | Teetzel et al. | |
| 2015/0233673 | A1* | 8/2015 | Kohnen | F41F 1/06 89/41.17 |
| 2015/0233676 | A1* | 8/2015 | Brown | F41G 1/50 89/37.05 |

* cited by examiner

SIGHTING DEVICE FOR HANDHELD MORTAR SYSTEM

CROSS-REFERENCE TO RELATED PATENT APPLICATIONS

NONE

STATEMENT REGARDING FEDERALLY SPONSORED RESEARCH OR DEVELOPMENT

NONE

BACKGROUND OF THE INVENTION

Field of Invention

The present disclosure generally relates to sighting assemblies for military mortar systems. More particularly, the present invention is a field sighting device removably attachable to handheld battlefield mortars.

Description of Related Art

Indirect fire weaponry plays a critical role in modern warfare. Military history has repeatedly demonstrated the effectiveness of indirect fire artillery systems such as mortars: their rapid, high-angle, plunging fires are invaluable against dug-in enemy troops and targets in defilade. Their ability to launch explosive projectiles in a high, parabolic trajectory with a near vertical descent makes it possible to launch attacks from positions lower than the target of the attack.

Mortars are specialized for mobility, tactical flexibility and short range target engagement. Light mortars may be manpacked across all terrain to meet rapid changes in tactical situations on the battlefield. Their light weight and simplicity allows mortarmen to move them rapidly and engage targets quickly with a high volume of fire. Agility and flexibility make light mortars well suited for close protective fires in any direction, in urban combat and over close terrain with restricted visibility. An inherent advantage of the light mortar is its speed and agility of use.

The current United States (U.S.) light mortar system is the M224 60 mm light mortar which comes equipped with a mortar tube, a base plate and a bipod with a sighting device attached to the bipod mount. The 60 mm mortar is a muzzle-loaded, smooth-bore, high-angle-of-fire weapon. Projectiles can be drop-fired or trigger-fired. The mortar may be fired in conventional mode with a bipod or in handheld mode with a baseplate. The baseplate upper side surface is formed with a socket into which the mortar base end is locked by securing a locking arm mechanism. The underside surface of the baseplate is provided with spikes or spades to stabilize the mortar during firing and transfer some recoil momentum to the ground. Attached to the base end of the mortar tube is a combination carrying handle and firing mechanism. The firing mechanism includes a trigger, firing selector and a range indicator only used for handheld mode. Thus, when used in handheld mode, no sighting device, other than the human eye, is employed.

Handheld mortars deliver indirect fire on a ballistic trajectory at a target which cannot always be seen by the aimer. Direct fire weapons, in contrast, require a sighting device and must have an unobstructed view to the target such that no objects or friendly units are between the weapon and the target. Direct fire thus refers to the launching of a projectile directly at a target within the line of sight of the aimer. Although indirect fire also may be used when the target is visible from the firing position it is generally used when the target is at longer range and obscured from sight due to the terrain or battlefield conditions. In conventional mode, indirect fire does not require a direct line of sight to a target because shots are normally directed by a forward observer (FO). The FO maps and determines mortar positons to target locations then transmits a call for fire to put artillery rounds on a target. Distance and direction are the two critical components of the call for fire. A mortarman generally uses aiming posts or a reference point, maps, compass, binoculars, or other devices or methods to determine the direction of fire. Because of their parabolic trajectories, indirect fire weapons can effectively be fired over obstacles or friendly units. In handheld mode, mortarmen maneuver into close range with the enemy and observe and direct their own fire. These mortar crews are also responding to defensive calls for fire from other infantrymen verbally calling out distance and direction to deliver fire on target.

In handheld mode, mortars systems are generally limited to only the tube and the baseplate so they can be assembled at the front and placed into operation quickly; the tube is sighted by hand although this reduces its accuracy. Mortar crews generally maneuver forward with other infantrymen so they can see where their targets are and where their rounds land. Because the mortarmen are moving with the maneuver element, they can see friendly forces and are often within yelling distance of the battlefield leadership. This allows them to shift fire as friendly troops advance and hit changing target priorities in real time in response to direct communication with battlefield leaders. They can quickly react to changes in the combat situation and stay at the front as the battle lines shift. If necessary, a handheld mortar on the front lines can still fire from a defiladed position if an FO or other soldier provides targeting adjustments to the mortarman.

When responding to the call for fire, a mortarman is responsible for aiming the mortar in the correct direction and at the proper angle to strike his target. Sighting in handheld mode is achieved starting once the mortarman sets the baseplate firmly on the ground; he takes up a kneeling position behind the mortar and customarily uses his left hand to hold the tube below the muzzle with his thumb in line with the tube. Next, he puts his right hand on the handle trigger and points the mortar toward the target by aiming his thumb in the direction of the target. As the mortarman sets the firing selector he must take his eyes off the target and look downward to the range indicator. An assistant gunner drops a round into the muzzle and releases the round. When the round reaches the base of the tube it hits a fixed firing pin that fires the round. Some mortars have a moving firing pin operated by a lanyard or trigger mechanism.

The angle of inclination of the mortar tube from the horizontal plane determines the distance that the mortar round travels. The tube is generally set at an angle of between 45 and 85 degrees to the ground, the higher angle produces a shorter horizontal round trajectory. The angle of fire is adjusted using a range indicator attached to the mortar handle. Because the mortar tube moves after firing a round it must be re-aimed manually after each round is fired. The mortarman continues to adjust his aim with subsequent firing to achieve target hit probability. The mortarman must continuously take his focus off of the target to readjust the angle of fire. The mortarman lays-in the weapon by calculating azimuth and elevation angles to the target position, bracketing the target or creeping fire, correcting range by observing the fall of the shot onto the target and calculating new angles, i.e. adjusting or ranging fire. Acquiring these skills takes time, training and substantial practice to master the skill of placing accurate fire.

It is challenging to calculate distance and direction prior to firing when using a mortar in handheld mode. Direction, termed azimuth, bearing, or deflection, is obtained by traversing the tube side to side through a horizontal angle. Distance, termed range or elevation, is obtained by vertical axis tilt of the tube, i.e. angle of inclination from the horizontal plane. Moreover, when a mortar is fired, the tube moves due to powerful recoil momentum. The shock of recoil causes lateral displacement and subsidence of the baseplate. Every time the tube moves it must be re-targeted again before firing.

In handheld mode, the mortar round is generally used with an integral charge, that is, a charge already in the mortar shell, termed zero charge. This can propel the round to a maximum first distance. Also in handheld mode, the mortar round may be used with a single charge which is added to the bottom of the projectile in addition to the integral charge, thus propelling the round to a maximum second distance which is greater than the maximum first distance. By changing the angle of the mortar tube with respect to the ground, different elevations, distances, and trajectories can be achieved to hit targets while in defilade.

A mortarman engaged in combat is always at risk of exposing himself to return fire from the target. Mortarmen ordinarily cannot perform as well while they are under fire. Smoke, noise, fragments and flying debris make it more difficult to hit their targets accurately and perform other combat functions. A mortarman needs to fire rapidly but accurately in order to enhance mission accomplishment and survivability. Target acquisition and reacquisition is required continuously to correct range and bearing because of recoil and subsidence from firing. Calculating distance and trajectory to target, elevation and windage while under fire is sufficient to introduce errors into the aiming process. It is difficult enough to hit a target when the projectile has a high arcing trajectory. This difficulty is compounded when the mortarman must take his focus off of the intended target to adjust elevation measurements and perform rapid trigonometric calculations on the battlefield. Ultimately, inaccurate firing and short rounds lead to less effective combat power, wastes ammunition and imperils friendly troops.

Moreover, as troops have become increasingly reliant on Global Positioning System (GPS) satellite and ground station radio-navigation, those systems have increasingly become the target of enemy intervention, including jamming. GPS and sensitive electronics can fail due to inclement weather, poor communication links or enemy attack. Soldiers are often in situations where GPS does not function well such as in dense urban environments. Like all radio-based services, GPS is subject to interference from both natural and human-made sources. A GPS unit can lose reception in the presence of radio jamming devices. Solar flares can also disrupt GPS equipment. Troops deprived of GPS need alternate means of navigation and positioning.

Rugged mechanical sighting devices are more reliable in a GPS-challenged situation or environment. Such reliability makes mortar sighting systems more robust by providing mortarmen with enhanced flexibility and capability to meet a broad range of scenarios. This becomes particularly crucial at a time when GPS electronics are under attack. Targeting and sighting systems must be capable of operating with GPS when it is available, but also when GPS is not available. Mortars must provide accurate indirect fire at all times, regardless of the availability of GPS.

Some attempted solutions, such as U.S. Pat. No. 9,207,044 B2 have proposed tube mounted electronic tilt sensor modules linked to microprocessors and LED displays with pre-programmed data options, but this has not sufficiently addressed the needs of mortarmen in harsh environmental battlefield conditions owing to its fragility and sensitive electronics. U.S. Pat. No. 7,637,198 B2 proposes electronic sensors and launchers mountable to a baseplate-linked bipod for an 81 mm mortar fired in conventional mode, but this solution has not sufficiently addressed the needs of light mortar gunners owing to its time-consuming data input and menu selection processes. U.S. Pat. Nos. 2,478,898 and 4,206,190 propose tube mounted sights for bipod mortars fired in conventional mode but have not met the needs of handheld mortars on the battlefield due to time-consuming and labor-intensive assembly and emplacement required of bipod systems. U.S. Pat. No. 6,568,118 B1 proposes a sighting assembly that is used with laser or reflex sights for an M-16 rifle barrel-mounted grenade launcher but this has not sufficiently addressed the needs of light mortar gunners in battle conditions owing to its requirement for battery power for the electronic sights.

A mortarman's equipment is of vital concern for both the man and the military to insure effective infantry operations. There is a need for the mortarman to maintain combat ready support weapons without being overburdened. A lightweight mortar must be agile, adaptable, easy to operate and yet possess enough accuracy to provide infantry with quality close fire support against targets more quickly than other means. A sighting device that is rugged, light, compact, durable, relatively inexpensive to construct, highly accurate yet easy to use without failure is a significant improvement over known devices by allowing rapid target acquisition and reacquisition, faster delivery of precision fires and placing "steel on target" within seconds of receiving the call for fire.

BRIEF SUMMARY OF THE INVENTION

The present disclosure is in general directed to a novel device for a mortar sighting attachment and assembly that permits adjustment of distance ranges and azimuth to a target. In accordance with the disclosed embodiments of the claimed invention the device for sighting and aiming handheld mortars is provided that includes a bracket mounted sighting attachment affixed proximal to the distal, discharge end of a mortar tube. The bracket is adapted to be mounted in alignment with a longitudinal centerline of the mortar tube corresponding to the bore of the tube. As a general embodiment, the claimed invention is an inexpensive and accurate sighting device in the form of a compass mounted in a housing supportably received in a bracket which in turn is mounted on an upper surface of a collar. The collar includes a pair of spaced mounting rings which are used for installing the collar aligned with the centerline of the bore axis of the mortar tube. Each mounting ring is a split ring composed of an upper ring section and a lower ring section. Bottom portions of the collar are interconnectedly attached to top portions of the lower mounting rings. The mounting rings are formed with shoulders at attachment points having countersunk holes to receive mechanical fasteners. The mortar tube is placed in the lower mounting ring sections and the upper mounting ring sections are fastened to the lower mounting ring sections to securely affix the collar in place around the distal, discharge end of the mortar tube. The compass is affixed in its housing by a first quick release camming device allowing quick fastening and unfastening without the use of tools. When the compass is placed in the compass opening of the housing the first quick release cam is actuated by rotating it approximately 180 degrees which moves a spring mounted compass clamp to secure the compass tightly in the compass housing. The compass housing is rotatably affixed to the upper portion of the collar by a second quick release camming device. The bottom portion of the collar is attached to the top portion by mechanical fasteners. The collar has distance indicators generally to the right and left of the compass housing which provides a clear view of the direction to target. The distance indicator on the left provides firing distance information using zero charge at any given angle of the mortar. The distance indicator on the right provides firing distance information using a single charge at any given angle of the mortar. A pivotable compass covering component is provided with an aperture including a sight blade which is a compass sight blade. By aligning the compass sight blade with the mortar's directional indicator the mortarman establishes the proper angle or direction to the target. After determining the distance to the target in one of many ways, such as by direct communication, a Forward Observer or a known map distance, the mortarman can adjust the angle of the mortar to the distance required, accounting for the charge being used in the projectile. Having the distance and direction to target by such a targeting system allows the more accurate use of a handheld mortar by providing the distance and angle to the target by accurate geometrical devices as opposed to currently used methods.

In accordance with one aspect of the present disclosure, the compass sight blade and a front sight blade align with a direction to target area to form a sight picture. The front sight blade may be fabricated out of metal, plastic or a suitable light-weight, durable material. The front sight blade is positionable on the mounting bracket so that the mortarman can view the sight picture through the aperture when the pivotable compass covering component is opened.

In accordance with another aspect of the present disclosure, distance and charge scale indicator dials, mounted adjacent the compass, provide a faster, more reliable sighting device. This is accomplished by providing a visual indication of distance-to-elevation to a target without the need for the mortarman to look down and take his eyes off of the intended target area. The dials' casings house an inner wheel upon which a marker is inscribed with distance indicia, charge indicia and a pointer. The wheel is free to rotate independently of the casing and a stabilizer comprised of a weight keeps the dial fixed relative to the horizontal plane, while the casing rotates with the mortar tube as the user moves the tube through the vertical axis. In an illustrative embodiment a "charge one" scale dial is provided in a visibly larger size than a "charge zero" scale dial to provide the user an intuitive visual signal which dial corresponds to the greater charge thereby providing faster targeting and firing. The dial is calibrated with cosines corresponding to the angles at which the tube may be positioned. The cosine function is translated directly into distance-to-elevation readings on the dials to thereby display range gradient indicia graduated in meter increments, removing the need to make trigonometric calculations while in the heat of combat, thereby achieving faster and more accurate targeting and firing.

In accordance with another aspect of the present disclosure, a compass bubble level provides visual indication of any off-angle tilt of the mortar tube. A sight blade bubble level operates to ensure that the sight blade remains at a central apex of the mortar tube perpendicular to the longitudinal bore axis of the tube when the mortar is leveled so that the bubble is centered and directed in the general direction of the target.

In accordance with another aspect of the invention, the sighting assembly provides luminescent dial indicia, pointers, and front sight blade to facilitate night firing and firing in low light levels thereby reducing the need for errant light sources and thereby reducing the exposure of personnel to enemy fire.

In accordance with yet another aspect of the invention, the mounting rings include sling loops and rails. The sling loops permit a user to attach a sling to thereby conveniently carry and handle the mortar. The rails may be a Picatinny-type rail as well known in the art. The rail or rail base is an elongated structure including a number of evenly spaced upwardly extending rail projections with evenly spaced transverse slots therebetween to provide for selective location of other mortar accessories.

In accordance with still yet another aspect of the present disclosure, the bracket mounted sight, compass, compass covering component, sight picture, distance and charge scale indicator dials, and bubble levels allow rapid centering and aiming of the mortar thereby permitting more rapid target acquisition, reacquisition, and rate of fire.

Handheld mortar use pertains generally to the use of a light mortar, which may be fired by hand without the use of a conventional bipod or tripod. The current invention as recited in the claims may be employed on the mortar when employing the hand firing method. The claimed invention may further be employed with the M224 60 mm Lightweight Mortar, which is a smooth bore, muzzle loading high angle of fire weapon used in the combat arms of the U.S. military for close-in support of ground troops. Other military organizations have in their equipment arsenals light mortars; these mortars may be used in accordance with the instant invention as recited in the claims as well.

The time to sight is reduced by using the mortar sighting device of the present disclosure of the claimed invention for indirect targeting which makes it quicker to place accurate fire on target. Such advantages further provide greater economy in expending projectiles. Such a mortar sighting device is also less expensive and more reliable than fragile electronic systems.

Advantageously, the sighting device allows for an improved bracket mounted mortar sighting attachment which permits rapid and accurate adjustment of both distance and azimuth to a target.

The systems and methods of the present disclosure have been developed in response to problems and needs on the battlefield that have not yet been fully resolved by currently available systems and methods. As will be readily appreciated from the foregoing, the present invention avoids the disadvantages of currently available systems and methods; thus, the systems and methods disclosed herein provide a solution to current challenges within the art. These and other features, aspects and advantages in accordance with the claimed invention will become better understood with reference to the following description, appended claims and accompanying drawings.

The above summary is provided merely for purposes of summarizing some example embodiments of the invention so as to provide a basic understanding of some aspects of the invention. Accordingly, it will be appreciated that the above described example embodiments are merely examples and should not be construed to narrow the scope or spirit of the invention in any way. It will be appreciated that the scope of the invention encompasses many potential embodiments, some of which will be further described below, in addition to those here summarized.

DETAILED DESCRIPTION

Embodiments of the claimed invention will be best understood by reference to the accompanying drawings, which are not necessarily to scale, and wherein like reference numbers indicate identical or functionally similar elements. For purposes of clarity, the spaces between the components are not to scale but enlarged to better illustrate the operation of the device. It will be readily understood that the components of the present invention, as generally described and illustrated in the figures herein, could be arranged and designed in a wide variety of different configurations. The claimed invention may be embodied in many different forms and should not be limited to the illustrated embodiments disclosed. Rather, these embodiments are provided so that this disclosure will be thorough and complete, and will fully convey the scope of the claimed invention to those skilled in the art. Thus, the following more detailed description, as represented in the figures, is not intended to limit the scope of the invention as claimed, but is merely representative of presently preferred embodiments of the invention.

FIGS. 1-13 illustrate schematically a mortar sighting attachment and assembly device for sighting and aiming handheld mortars. In the arrangement described herein, the mortar tube is oriented such that when the mortarman places the proximal base end on the ground when firing the mortar, the distal muzzle discharge end of the mortar is aimed in the general direction of the target and the tube is directed so that its bore axis lies in the plane determined by the mortar, the target and the vertical. The claimed mortar sighting device is mounted proximal to the distal discharge end of the mortar tube in parallel alignment with the longitudinal centerline of the axis of the bore thereby allowing the proper angle of elevation and the azimuth angle to be determined with respect to the mortar tube and the aforementioned vertical plane.

Figure 1:
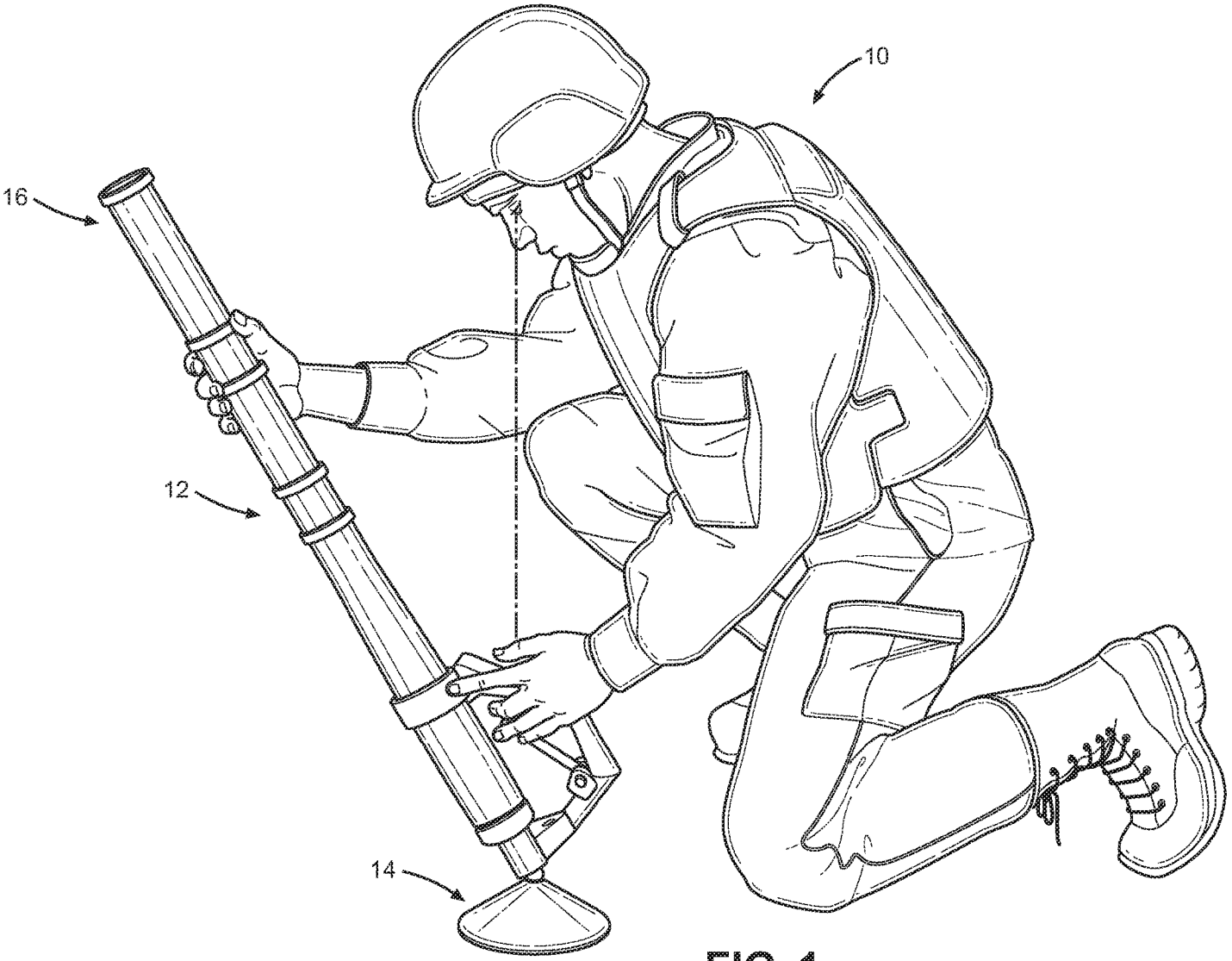
FIG. 1 PRIOR ART
FIG. 1, labeled "PRIOR ART", is a view of a user sighting vertically downward to a mortar handle range indictor.

Referring now to the Figures in more detail, as best depicted in FIG. 1, labeled "PRIOR ART", where reference numeral 12 indicates a tube of a mortar fired in handheld mode by a gunner or mortarman 18. The mortar tube 12 has a proximal base end 14 including a firing mechanism and a distal discharge end 16 including a muzzle.

Figure 2:
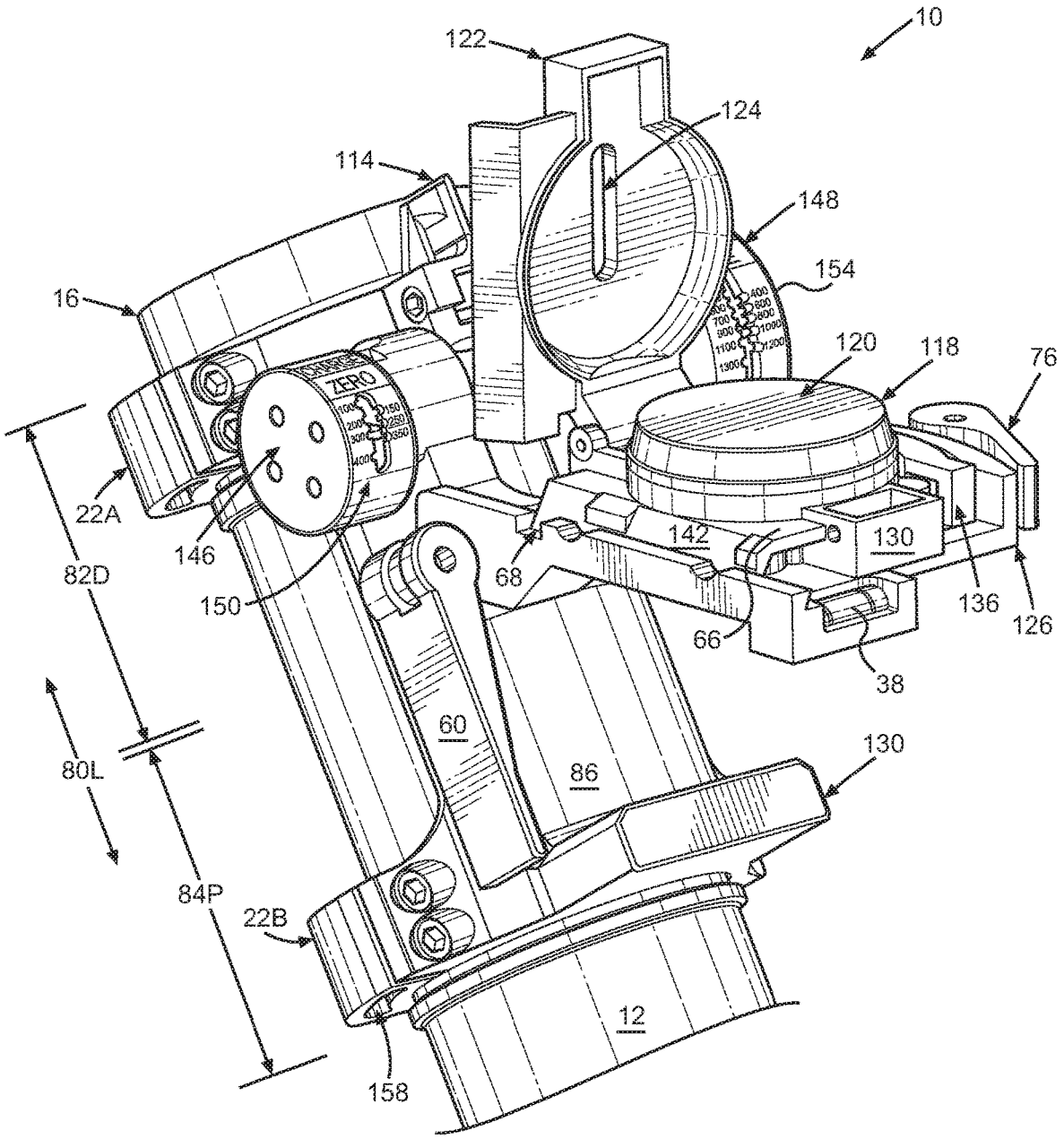
FIG. 2 is a partial perspective view of the sighting system affixed to a distal, discharge end of a mortar tube.
Figure 3:
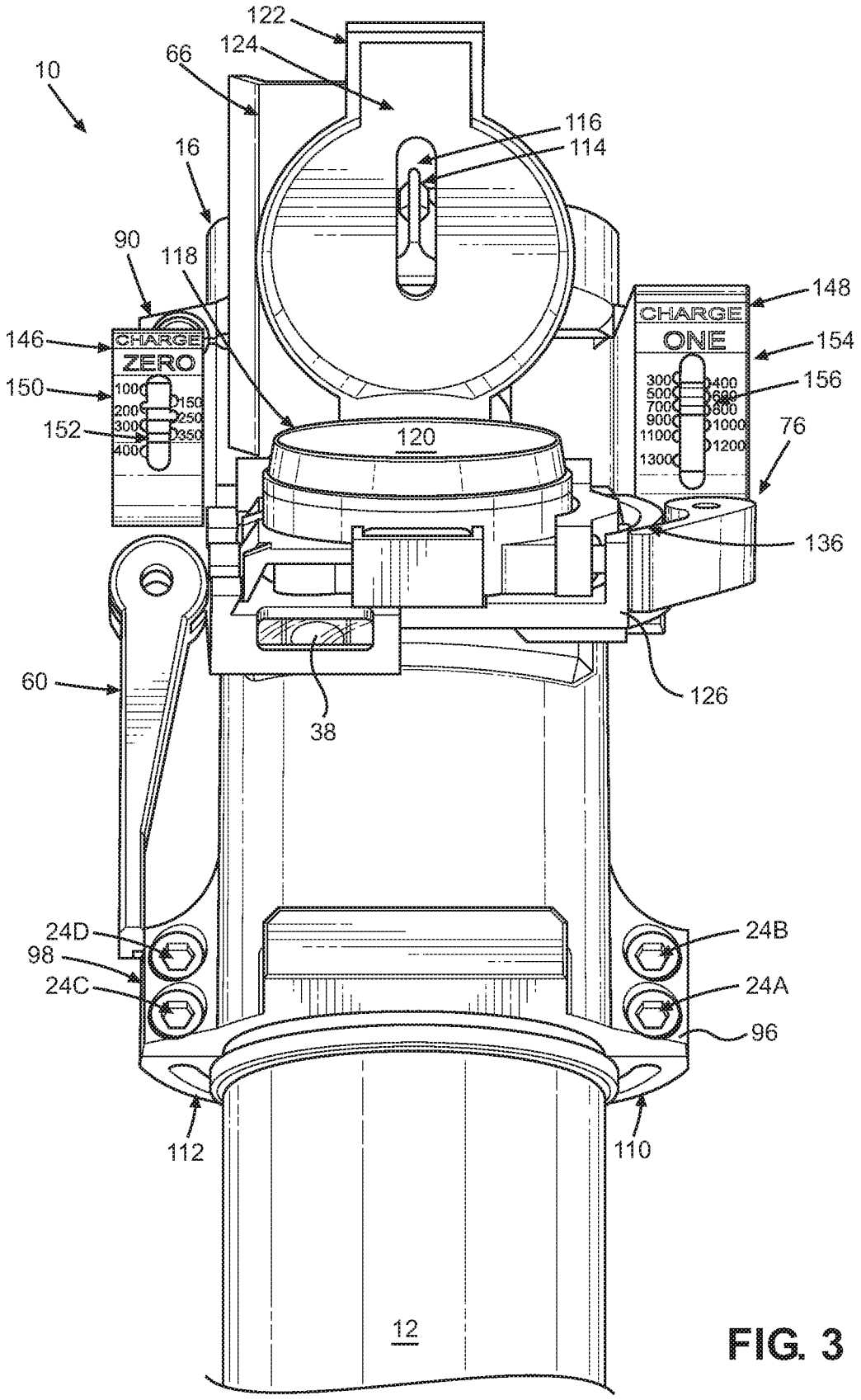
FIG. 3 is a front view looking along a longitudinal axis of the mortar tube with the sighting system affixed thereto.
Figure 4:
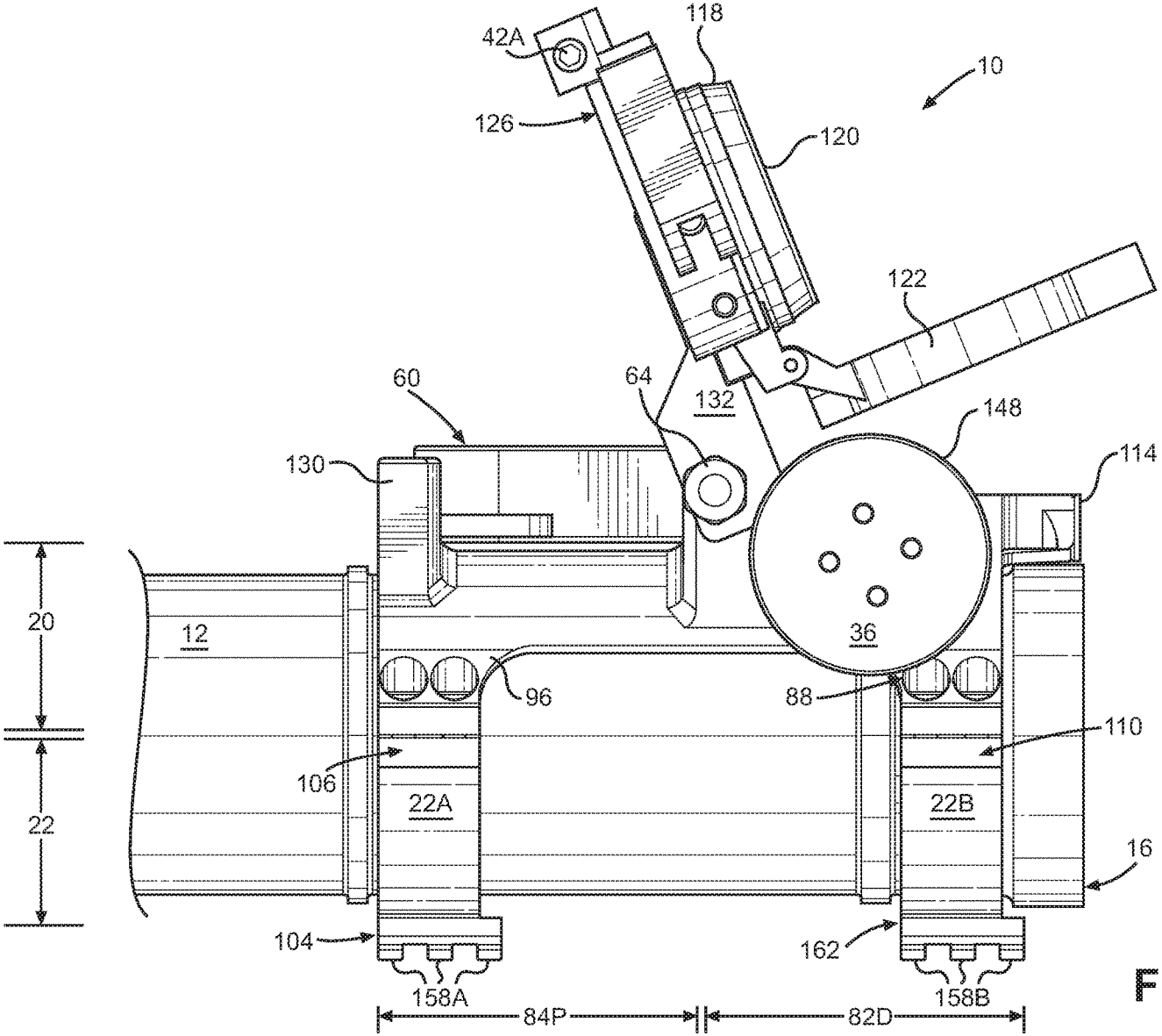
FIG. 4 is a partial right side view of the sighting system affixed to the distal, discharge end of the mortar tube.
Figure 5:
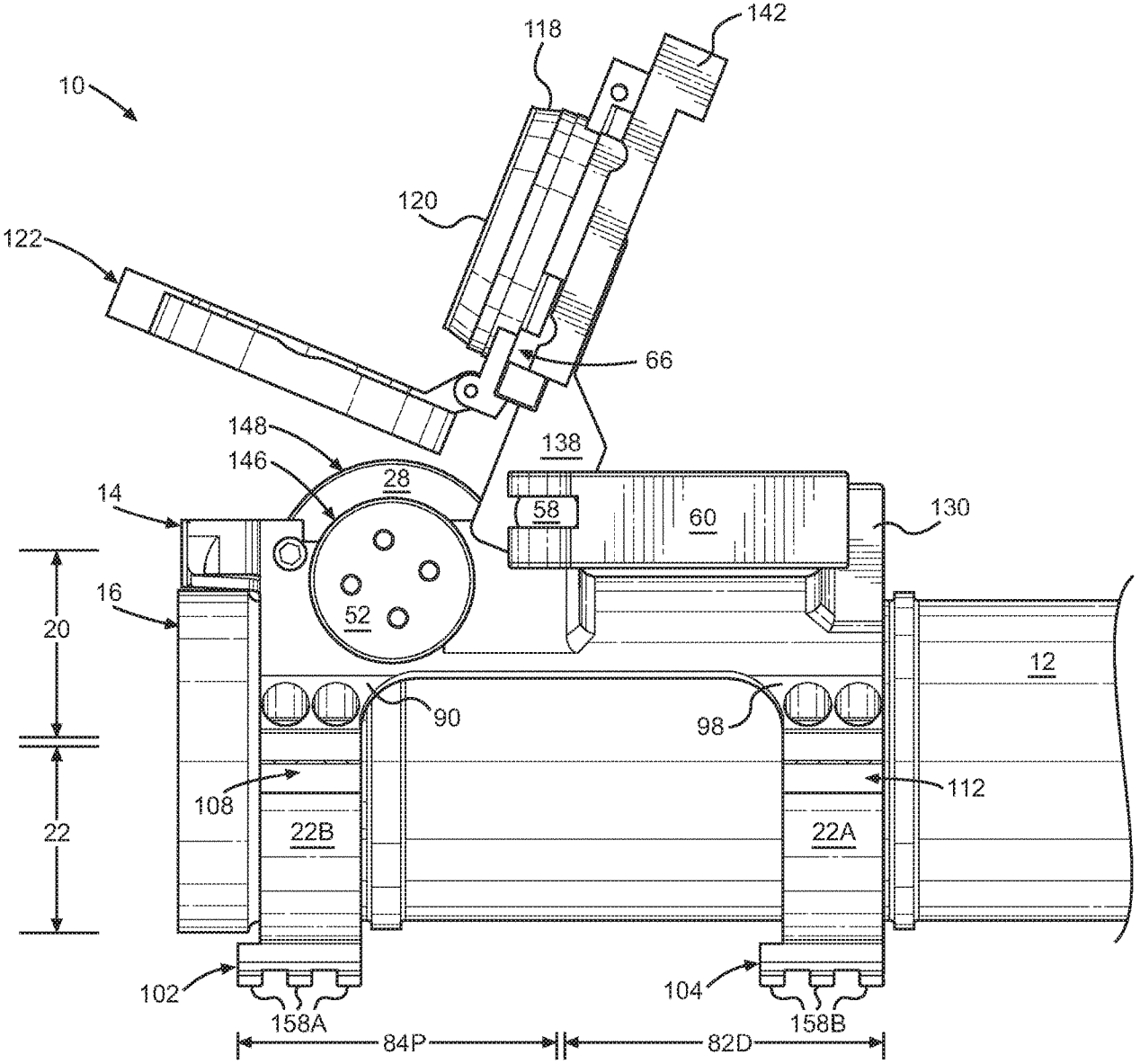
FIG. 5 is a partial left side view of the sighting system affixed to the distal, discharge end of the mortar tube.

As shown in FIGS. 2-12, a removably attachable sighting device 10 affixed to a mortar tube 12 for handheld firing operations is shown. Turning now to FIGS. 2, 4, 5, 9 and 10, a tube mounting structure is formed as a collar 80 having a generally convex shape to securely clamp around the mortar tube 12 at its distal discharge end 16. Collar 80 has a top half portion which has a longitudinal extent 80L, a proximal end portion 84P and a distal end portion 82D separated by an intermediate arcuate plate 86 as shown in FIG. 2. Proximal end portion 84P, distal end portion 82D and intermediate arcuate plate 86 together form an upper carrier plate portion 20 which is attached to a bottom portion 22, as shown in FIGS. 2 and 4-5. The bottom portion 22 includes a proximal end collar attachment in the form of a mounting ring 22A, and a distal end collar attachment in the form of a mounting ring 22B. Mounting rings 22A, 22B are adapted and arranged to be attached at axially spaced end portions of collar 80. Although the preferred embodiment depicted in FIGS. 2, 4-5 and 10 includes mounting rings, those of skill in the art will understand the term "mounting ring" is used in a functional sense indicating a generally C-shaped structural member. Examples of other forms include, but are not limited to, clamps, saddle clamps, latches, bands and straps. Those of skill in the art will understand that any suitable attachment member may be used in forming the mounting rings described herein. Those of skill in the art will understand that a number of variations may be made in the disclosed embodiments, all without departing from the scope of the invention which is defined solely by the appended claims.

Figure 9:
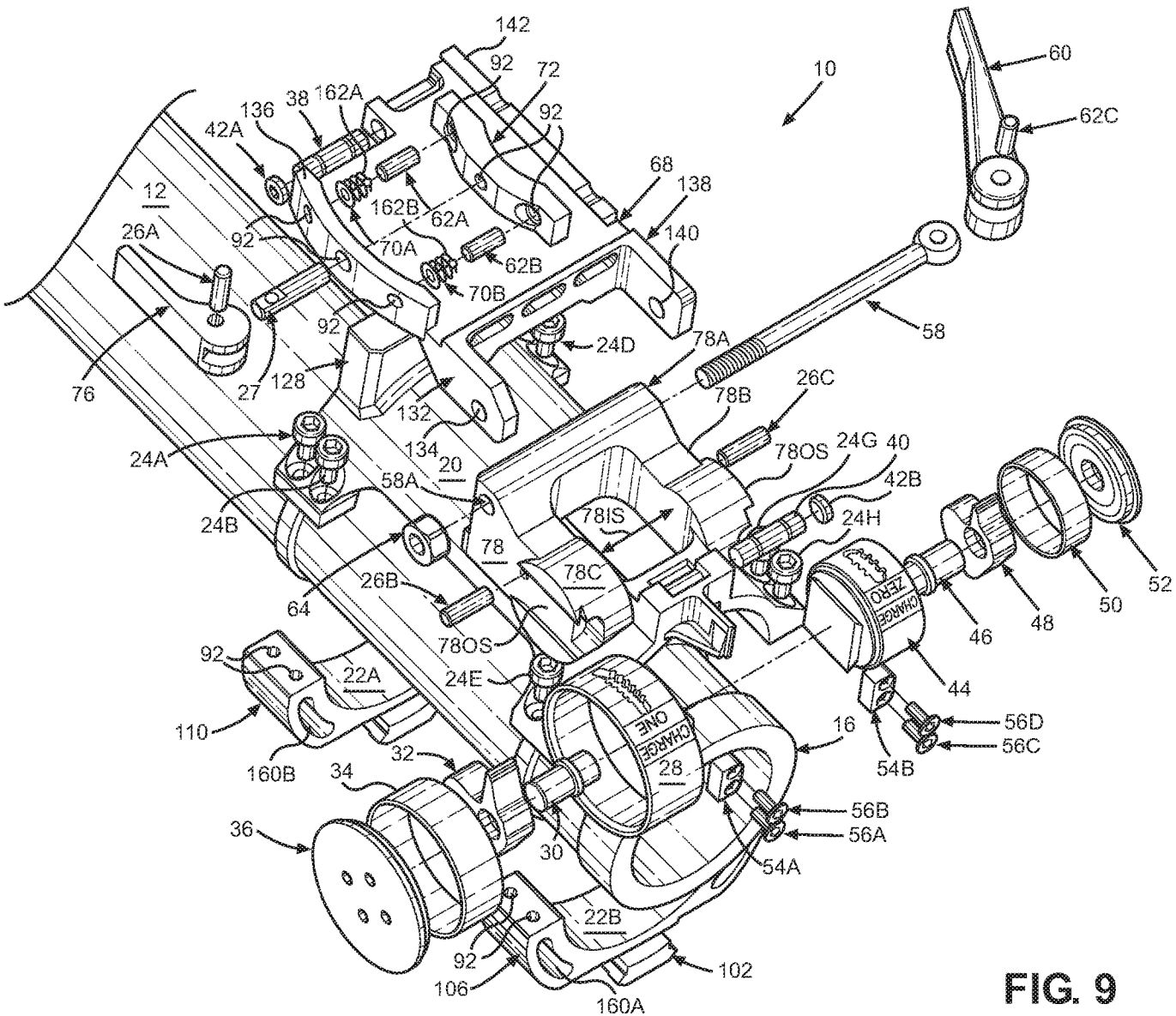
FIG. 9 is an exploded view of the sighting system for use with a lightweight mortar.
Figure 10:
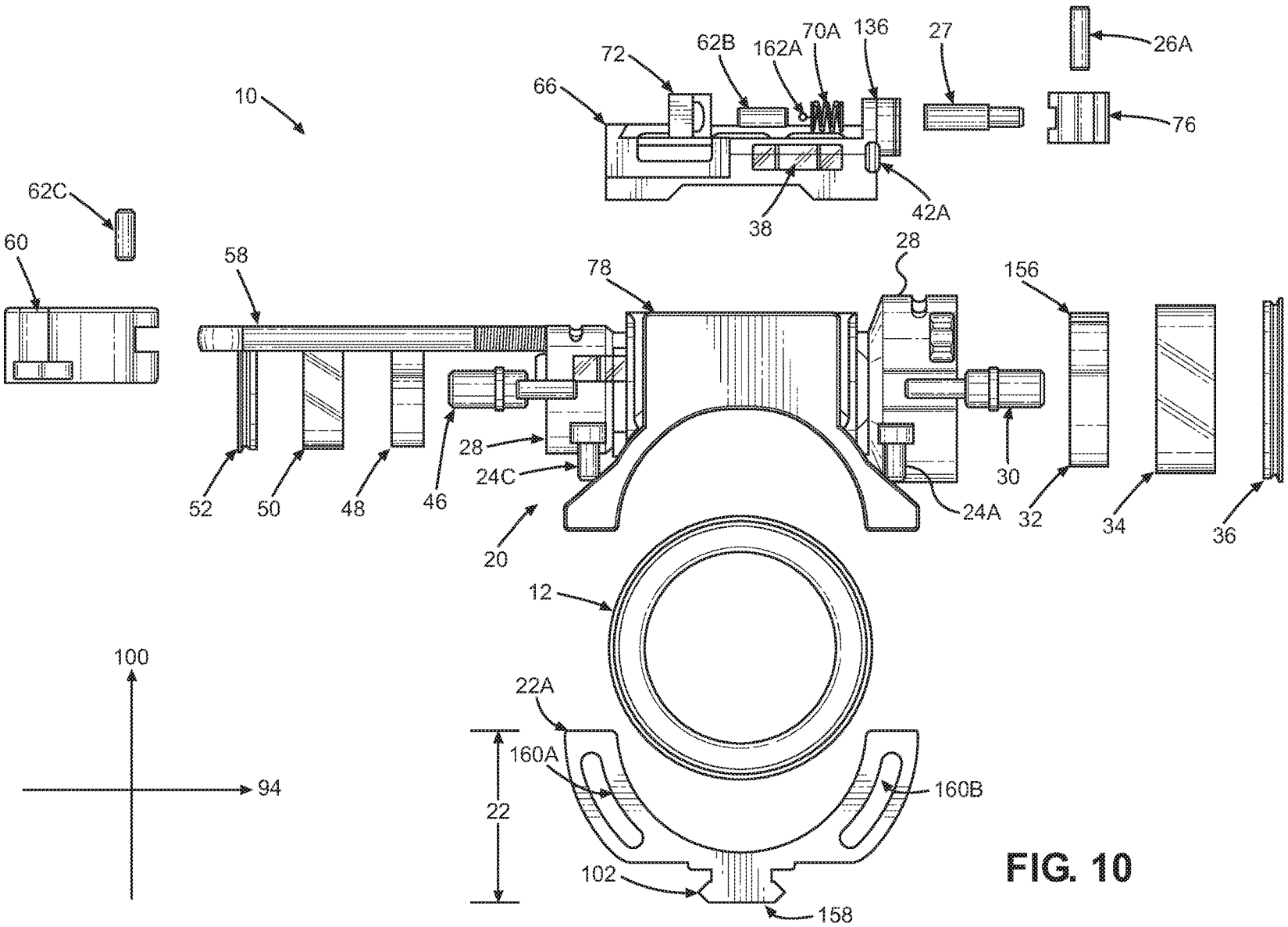
FIG. 10 is a rear exploded view of the sighting system for use with a lightweight mortar.

As best depicted in FIGS. 2 and 9, collar 80 upper carrier plate portion 20 at proximal end portion 84P further includes a bracket formed as a hub 78 seated thereon for mounting compass assembly and sight assembly as explained further below. As shown in FIG. 10, the upper carrier plate portion 20 has a curved geometry which allows it to lay atop the outer diameter of the mortar tube 12 with high tolerance. Both upper carrier plate portion 20 and bottom portion 22 have opposed arcuate inner surfaces that define an opening for receiving the tubular body of mortar tube 12.

As shown in FIGS. 3, 4, 5, 9 and 11, the top half of collar 80 upper carrier plate portion 20 includes the distal end portion 82D which is formed with a right flange 88 and a left flange 90. The right flange 88 and the left flange 90 on the distal end portion 82D include apertures 92 which pass completely through each flange 88, 90.

The upper carrier plate portion 20 includes the proximal end portion 84P which is formed with a right flange 96 and a left flange 98. The right flange 96 and the left flange 98 include apertures 92 which pass completely through each flange 96, 98.

The bottom portion 22 includes a distal, front half collar 102 and a proximal, rear half collar 104. The bottom portion 22 distal, front half collar 102 is formed with a right flange 106 and a left flange 108. The right flange 106 and the left flange 108 includes apertures 92 which may be bores, such as, but not limited to, threaded bores, blind bores, countersunk holes, or apertures which pass completely through each flange 106, 108.

The bottom portion 22 proximal, rear half collar 104 is formed with a right flange 110 and a left flange 112. The right flange 110 and the left flange 110 include apertures 92 which may be bores, such as, but not limited to, threaded bores, blind bores or apertures which pass completely through each flange 110, 112.

As shown in FIGS. 3, 9, 10 and 11, contact surfaces of apertured flanges 88, 90, 96, 98, 106, 108, 110, 112 receive mechanical fasteners 94, which are cap screws 24*a*, 24*b*, 24*c*, 24*d*, 24*e*, 24*f*, 24*g* and 24*h*. 24*a*, 24*b*, 24*c*, 24*d*, 24*e*, 24*f*, 24*g*, 24*h* thereby securely affixing upper carrier plate portion 20 and bottom 22 portions to mortar tube 12 at the distal, discharge end 16 of the tube 12. Other fasteners that would be suitable for alternative embodiments can be, but is not limited to, screws, bolts, pins, and any other fasteners that are available that have the material properties that would be suitable for alternative embodiments of the subject matter of the disclosure. Other methods of attaching the upper carrier plate portion 20 to the bottom portion 22, including adhesives, any type of welding, or other attachment means are included in the scope of the invention.

As shown in FIGS. 9 and 10, the top half of collar 80 on upper surface side of upper carrier plate portion 20 at distal end portion 82D includes a compass mounting bracket formed as a hub 78. Hub 78 includes a front element including range distance dials and a rear element including compass housing, as will be described further herein. Hub 78 is generally U-shaped and tapers in profile from a proximal apex 78A to a pair of spaced apart distally extending legs 78B, 78C of the U. A transversely extending aperture or bore 58*a* in apex 78A receives hinge bolt 58. Each of the hub 78 legs 78B, 78C further includes a first, outer side 780S and a second, inner side 78IS. The first, outer side 780S of each leg 78B, 78C includes an attachment point to which a distance indicator wheel is mounted. In an illustrative representation depicted in FIG. 9, an attachment point formed as an indent interlockingly engages a corresponding projection on a hub-facing surface of a distance indicator wheel to thereby form dovetail joints. As further depicted in FIG. 3, wheel 146, which includes a charge zero scale range dial 44 for a charge zero mortar projectile (not shown) is mounted on first, outer side of leg 78B; wheel 148 which includes a charge one scale range dial 28 for a charge one mortar projectile (not shown) is mounted on first, outer side of leg 78C, as will be more fully described herein.

As shown in FIGS. 2, 4, 5, 9, 12 and 13, hub 78 further includes compass housing 126 and compass mounting bracket subassembly lockingly receiving a compass plate 66, as will be more fully described herein.

Referring now to FIG. 2, the compass 118 of the sighting device 10 for a mortar tube 12 is shown. In preferred embodiments the compass 118 is a U.S. Military M-2 artillery compass designed for high accuracy, or a standard issue field compass such as the U.S. military's field compass. The term "compass" is used in a functional sense indicating an instrument for orienteering. These instruments are readily available, are used frequently in the military, and those of skill in the art are familiar with working with such compasses. Those having ordinary skill in the art will understand that other compasses suitable for alternative embodiments include, but are not limited to, digital compasses, compasses having a magnifying lens or a lens on its rear sight for magnifying the compass scale, card or dial for taking a more accurate reading, or any other compass that is suitable for taking a bearing, taking a sighting to a target, or performing a resection.

Compass 118 is adapted to removably reside in housing 126, as will be further described herein. As shown in FIGS. 2-4, 6-7 and 9-10, a first cross level which is a compass bubble level 38 mounted by set screw 42*a* on exterior top side sidewall 164 of housing 126 is adapted and arranged to provide a visual cue to signal to the mortarman that the mortar tube 12 is oriented and centered in the general direction of the target area. As shown in FIGS. 6, 7, 9 and 12, the distal end of hub 78 provides a platform for a second bubble level which is a sight blade bubble level 40 adapted and arranged to be securely mounted by set screw 42*b* at a position proximal to the front sight blade 114 at a central apex of the mortar tube 12 at the distal discharge end 16 of the tube 12 and perpendicular to the longitudinal centerline 100 of the tube 12 corresponding to the longitudinal axis of the bore of the mortar tube 12. Sight blade bubble level 40 provides a visual cue to signal the angle of the mortar tube 12 from the horizontal plane 94 and the off axis vertical tilt of the tube 12 resulting from a change in angle caused as the tube 12 position is tilted or changed past a level position. Off angle tilt as the mortar tube 12 is raised or lowered to vary the vertical angle thereof the bubble in sight blade bubble level 40 will move lengthwise in the bubble level vial. As shown in FIG. 3, front sight blade 114 cooperates with a compass sight blade 116 and a compass cover sight aperture 124 to form a front and rear sight as will be more fully described herein. The angular position of the sight blade bubble level 40 is set such that the mortarman, without any substantial movement of his head, may glance through aperture 124 and note the position of the bubble to thereby adjust the tube 12 such that the bubble of sight blade bubble level 40 is centered in compass cover sight aperture 124. The mortarman's field of vision is the same for directional aiming and range, thus enabling him to read the two bubble levels 38, 40 simultaneously.

As shown in FIGS. 2-3, 6-7 and 9, distance to elevation dials in the form of charge scales and ranges for mortar rounds are adapted and arranged to be mounted one on each side of the sighting device 10. In a preferred embodiment the dials 146, 148 are adapted and arranged to flank the hub 78 and sight picture thereby allowing a mortarman to maintain focus and accurate sight line toward a target area for each selected range setting. Those of skill in the art will understand that other arrangements would be suitable for alternative embodiments of the subject matter of the disclosure. For example, the distance to elevation and charge scale dials may be mounted on only one side such as the right side or the left side of the sighting apparatus. Employing more than one distance to elevation conversion dial charge scale such as, by way of non-limiting example, using one on each side of the sight, is useful in order to account for different ballistics and discharge velocities of different charges, or distance to elevation dials for charge 2, 3, or 4 charge firings to cover the capability, mode and range of medium or larger caliber mortar systems, and other modifications are contemplated while remaining within the scope of the present disclosure or appended claims, as will be appreciated by those skilled in the art, along with other benefits and advantages of the present invention. The dials 146, 148 illustrated in FIG. 9 are not limited to the constructional detail shown there or described in the accompanying text. As those of skill in the art will understand, suitable dials may be mountedly affixed to the hub 78 of sighting device 10 by male dovetail portions which fit into corresponding female dovetail grooves in mating engagement, by mechanical fasteners including but not limited to pins, screws, bolts, and any other fasteners that are available that have material properties that would be suitable for alternative embodiments of the subject matter of the disclosure. Other methods of attaching the dials 146, 148 including adhesives, any type of welding, or other attachment means providing a secure attachment are included in the scope of the invention. Those in the art will understand that a number of variations may be made in the disclosed embodiments, all without departing from the scope of the invention, which is defined solely by the appended claims.

In an illustrative representation, as shown in FIGS. 2-3 and 6-7, to the left of the compass 118 a Charge Zero distance or range indicator in the form of a wheel 146 is located. To the right of compass 118, a Charge One distance or range indicator in the form of a wheel 148 is located. One of ordinary skill in the art will appreciate that the Charge Zero wheel 146 and Charge One wheel 148 distance range indicators are not limited to a left and right side respectively of the compass; however such a "left to right" placement provides a visual cue providing an intuitive signal to the mortarman of increasing charge from left to right corresponding to increasing numbers read from left to right. The Charge Zero distance indicator wheel 146 includes a charge zero distance scale 150 which can be, but is not limited to, meters or yards. The charge zero distance scale 150 may be coated with a luminescent or "glow in the dark" substance, such as, but not limited to, tritium, as will be further described herein.

Dials 28, 44 of wheels 146, 148, respectively, display a distance scale which is a distance to target as a range gradient which is a series of graduated numbers indicia 150, 154 in increments of meters. Distance scale indicia 150, 154 allow the mortarman to obtain instant feedback of the distance their round will travel based on the angle that the mortar is tilted and thus allow the mortarman to adjust his aim to achieve the distance to a target area as a result. This allows the mortarman to engage targets with the mortar weapon when the sight 10 is mounted thereto. In a preferred embodiment the indicia 150, 154 is luminescent to assist the mortarman in viewing the indicia at night, in the dark or in low-light conditions as will be described further herein.

A charge zero pointer 152 which moves in relation to the angle of the mortar tube 12 and the ground (not shown), indicates the distance a mortar projectile with its organic zero charge will travel downrange. The charge zero pointer 152 is inscribed or coated with a luminescent material composition or a "glow in the dark" substance, such as, but not limited to tritium.

On the Charge One distance indicator wheel 148 is a charge one distance scale 154 which can be, but is not limited to, meters or yards. The charge one distance scale 154 is inscribed or coated with a luminescent or glow in the dark substance, such as, but not limited to, tritium, as will be further described herein. The charge one pointer 156 moves in relation to the angle of the mortar tube 12 and the ground (not shown). The charge one pointer 156 points out the distance a mortar round will travel down range when an ancillary charge is affixed to the mortar projectile, which includes an organic charge. The charge one pointer 156 likewise may be inscribed or coated with a luminescent substance, such as, but not limited to, tritium.

In an illustrative embodiment as depicted in FIGS. 2-3 and 6-7, which is not necessarily drawn to scale, the Charge One distance indicator wheel 148 is physically larger than the Charge Zero distance indicator wheel 146. This allows the mortarman a clear and visible visual cue or signal in the form of an intuitively grasped physical indication of which distance scale wheel 148 corresponds to the greater amount of charge. A mortarman will intuitively grasp that the larger wheel indicates the larger charge. This will improve speed and accuracy of aiming and firing. The Charge Zero distance indicator wheel 146 and the Charge One distance indicator wheel 148 are fixedly mounted to hub legs 78B, 78C outer sides 780S. Both dial wheels 146, 148 have weighted or weight-stabilized internal pointer 152, 156 wheels or rings which are free to rotate independently of the outer distance dials and hence will always rotate so that the weighted portion of the internal pointer wheel is at the bottom of the distance dial due to the force of gravity and thereby keeping the wheel fixed relative to the horizontal plane 94. Thus, for any angle at which the mortar tube is moved upward or downward, the dial wheels' orientation remains fixed and the pointer on the weighted wheels align with a range on the distance dial expressed as a function of the cosine of the angle of the mortar tube. The dial is calibrated for the distance ranges indicated on the distance scales 150, 154.

As shown in FIGS. 2-5, compass 118 assembly includes a compass face 120 and pivotable compass cover 122. The pivotable compass cover 122 is movable between a first, closed position and a second, open position thereby allowing the compass to be collapsed into a minimum of space and provide a low profile when detached from the mortar or when not in use and attached to the mortar sight assembly. The compass cover 122 is formed with a narrow, vertically elongated aperture or window provided therethrough which is a compass cover sight aperture 124, as shown in FIG. 3. In the center of the compass cover sight aperture 124 is a compass sight blade 116. The compass sight blade 116 is positioned proximally of and aligned with a front sight which is provided in the form of a front sight blade 114 thereby forming a rear and front sight aligned with the direction to the target area and hence creating a sight picture. This alignment insures that the sight device 10 for a mortar is affixed correctly for proper sighting with respect to the longitudinal bore axis of the mortar tube 12. Front sight blade 114 is adapted and arranged on the sight to be positioned at a central apex of the discharge end of the tube 12. By looking through the compass face 120 to the compass scale or dial, a bearing or angle relative to north can be determined.

The compass declination, magnetic declination, or declination, that is, the bearing or angle relative to magnetic north, for purposes of this patent will be known as the azimuth. The magnetic declination or declination can be easily determined by employing the compass 118, and may be converted to a true north azimuth if needed. By using the compass 118, compass bubble 38 and the compass sight blade 116, the mortar tube 12 may be aimed by traversing or rotating the mortar tube 12 until the compass 118 indicates the tube 12 is aimed at the desired angle which the mortar weapon is to be fired. By using the distance to elevation dials 146, 148, front sight blade 114, and sight blade bubble level 40, the mortarman determines the angular elevation of the mortar tube 12 corresponding to the range of the selected target in meters between the target and the azimuth angle in degrees between the target selected aiming point. Both the angle and the distance to the target are generally determined by mortarmen when sighting by hand in handheld mode by observing where their targets are and where their rounds fall. When moving with the maneuver element on or behind the front lines, when unexpectedly encountering hostiles or targets of opportunity, when within yelling distance of battlefield leadership or responding to verbal calls for defensive fire from other infantrymen, or whether obtaining target adjustments by radio communications or other commands from an FO while firing from defiladed positions, the sighting device in accordance with the present disclosure provides improved accuracy which can provide first round hits such that the mortarman can react quickly to changes in the combat situation, move from position to position, and provide effective surprise fire, in daylight or dark. In difficult situations one mortarman can use the sighting device to both manually aim and fire the mortar to insure effective infantry operations and maintain combat ready support weapons without being overburdened.

Figure 6:
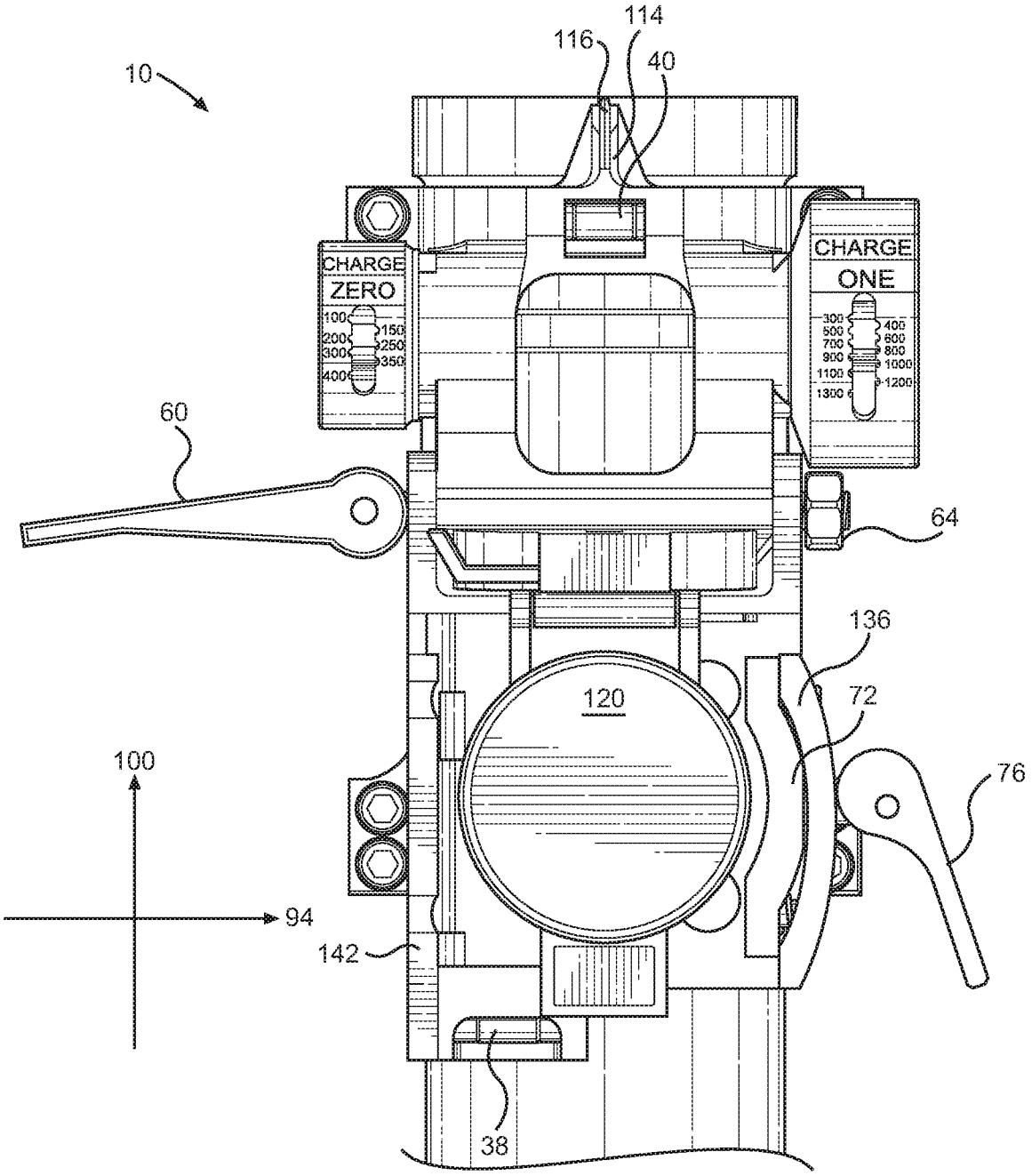
FIG. 6 is a top plan view of the sighting system in a first, open, unlocked position.
Figure 7:
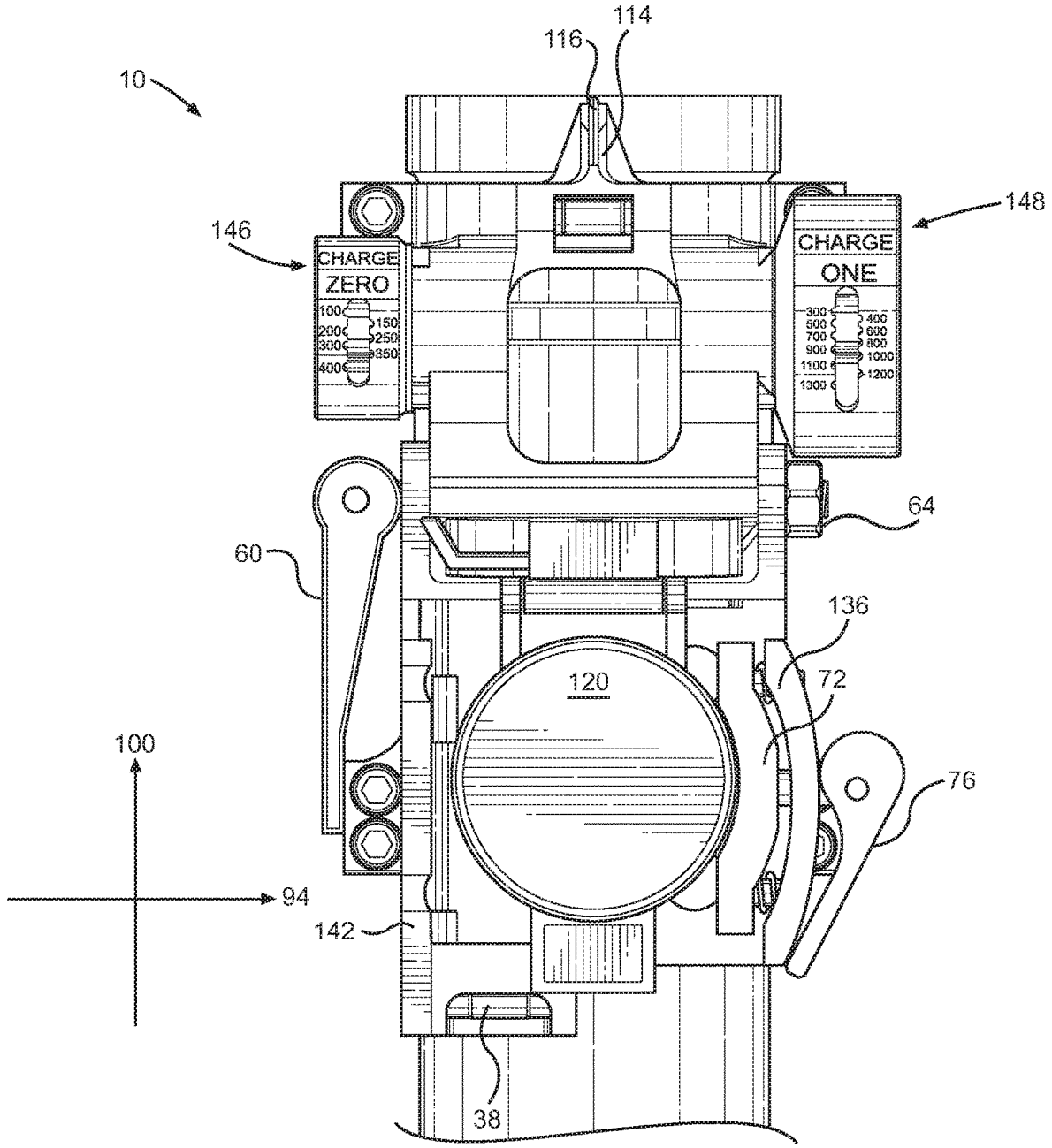
FIG. 7 is a top plan view of the sighting system in a second, closed, locked position.
Figure 8:
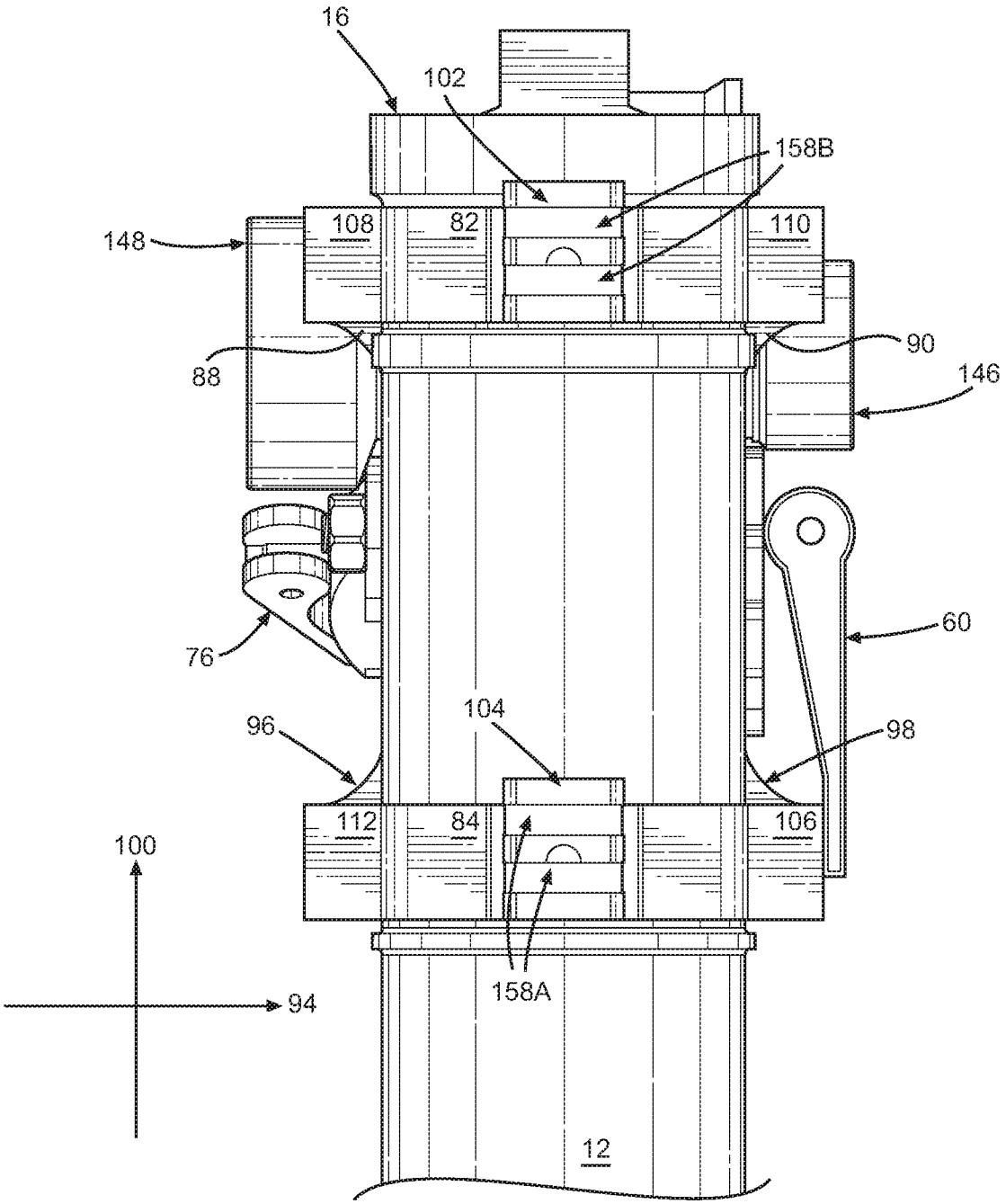
FIG. 8 is a bottom plan view of the sighting system affixed to the mortar tube.

As best depicted in FIGS. 6, 7 and 9, to provide quick assembly and disassembly of the sight 10 in relation to the mortar tube 12 mounting collar 80 assembly, a compass 118 mounting bracket subassembly is provided on the upper carrier plate portion 20 at proximal end portion 84P of the mounting collar 80 assembly. The compass 118 on compass plate 66 is removably seated and resides in compass housing 126. The compass housing 126 is attached to the upper carrier plate portion 20 through hub 78 aperture 58*a*, as best seen in FIG. 9, and which passes through an upper extension 128. The upper extension 128 is affixed to a position proximal the midpoint of the upper portion 20. The upper extension 128 may be affixed by any conventional means. The compass housing 126 mounting bracket subassembly includes a right leg element 132 and a left leg element 138 which extend in parallel forwardly toward the distal discharge end 16 of the mortar tube 12. Apertures 134, 140 are provided on both the right leg element 138 and left leg element 132, respectively, which are in co-axial alignment with transversely extending aperture 58*a* in hub 78 apex 78A. A first cam lever 60 is affixed to a hinge bolt 58. The hinge bolt 58 passes though the aperture 140 on the left leg element 138 to the aperture 58*a* and finally through the aperture 134 on the right leg element 132 where it is secured by nut 64. In an exemplary embodiment the nut may be a knurled nut 64 to provide a finger-gripping surface, as shown in FIGS. 4, 6, 7 and 9. The compass housing 126 pivots about the hinge bolt 58 when the first cam lever 60 is released. When the compass 118 is in the proper position, the first cam lever 60 is secured, locking the compass housing 126 in place. The compass housing 126 may be secured in such a position where the compass 118 is level with the ground to obtain an optimum angular reading.

Figure 12:
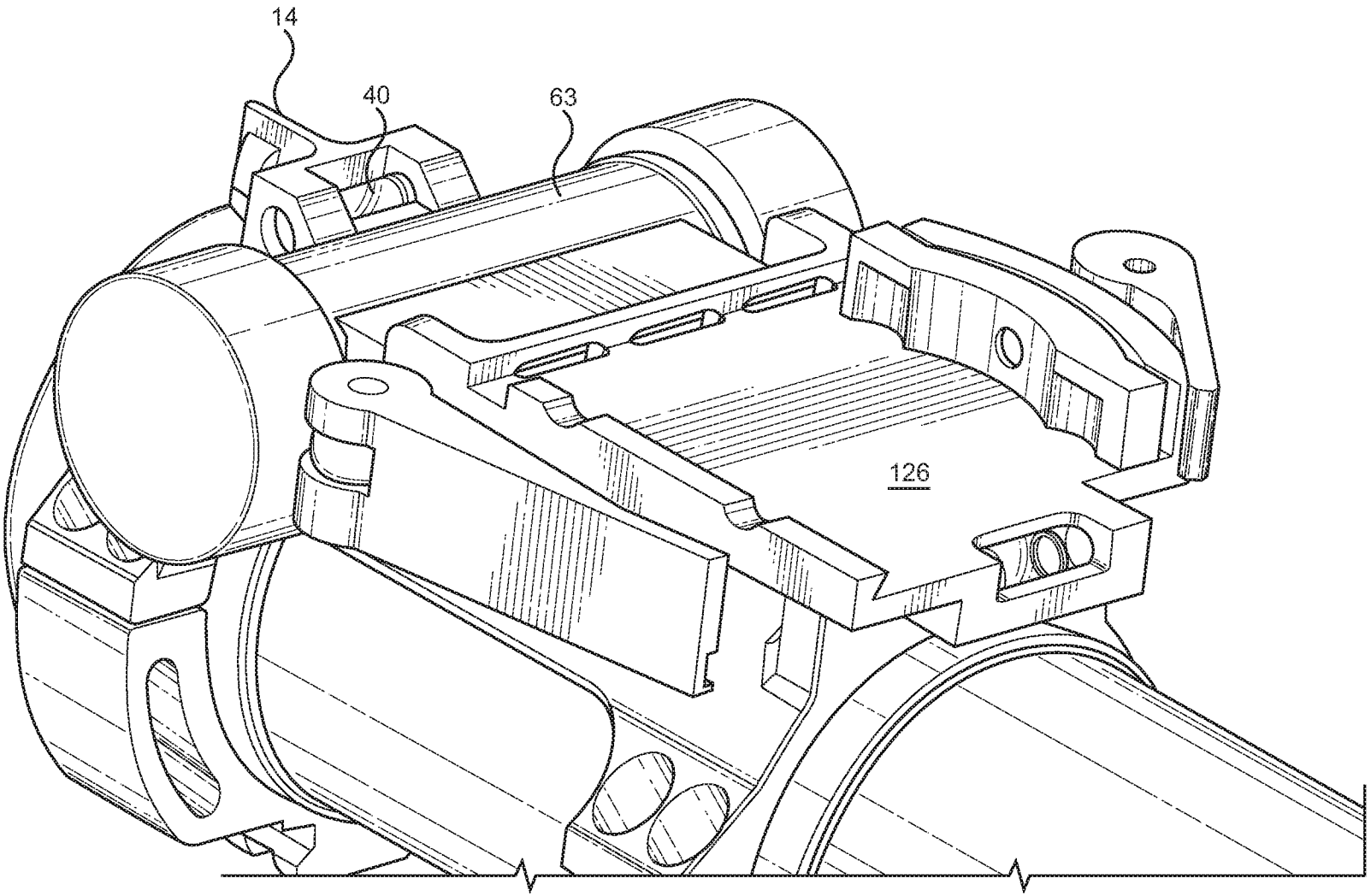
FIG. 12 is a partial left side view of the compass locking rails, front sight blade and sight blade bubble level.
Figure 13:
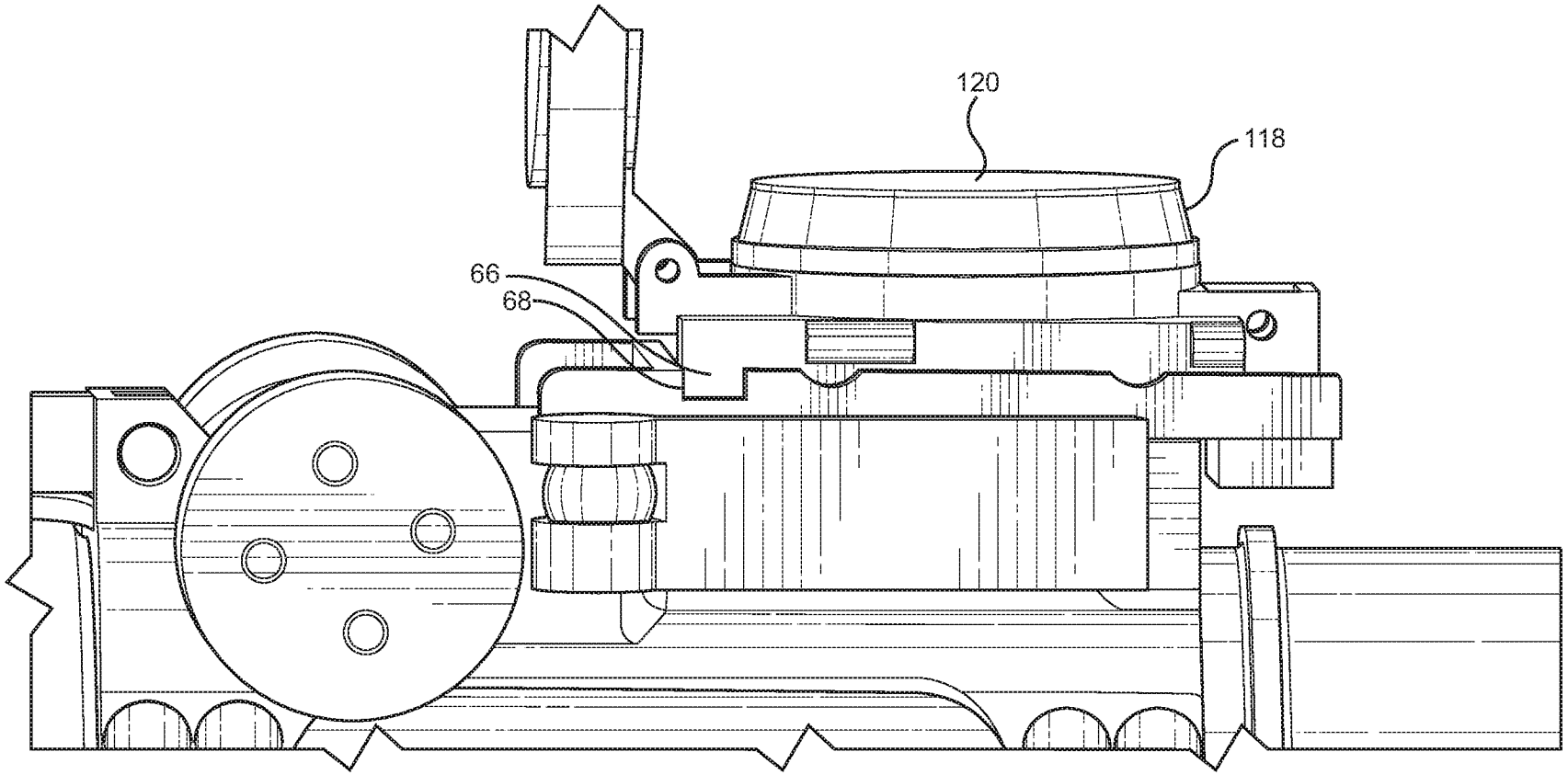
FIG. 13 is a left side view of compass locking rails locating and securing a distal end edge track of a compass plate.

Compass 118 is fixedly mounted on its compass plate 66 which is removably seated and resides in compass housing 126. As shown in FIGS. 12 and 13, locking rails 68 locate and secure compass plate 66 distal end edge in compass housing 126 track, as shown in side view in FIG. 12. The locking rail illustrated in FIGS. 12 and 13 is not limited to the constructional detail shown there or described in the accompanying text. The term "locking rail" is used in a functional sense indicating a generally elongated structural member formed horizontally as for an affixably securable support. The preferred embodiment employs a locking rail. Other structures are available for alternative embodiments that can include, but are not limited to, tongue and groove joins, dovetail joins, interlocking ridges, grooves and channels, mechanical fasteners, pins, bolts, screws, adhesives, welds, and any other suitable structures that will remain dimensionally stable and withstand the acceleration and firing shock to which the tube-mounted structure is subjected along with temperature rise generated from repeated firings. Those in the art will understand that any suitable securement, now known or hereafter developed, may be fabricated for removably securely retaining the compass in the housing and sight device described herein. Those in the art will understand that a number of variations may be made in the disclosed embodiments, all without departing from the scope of the invention, which is defined solely by the appended claims.

Figure 11:
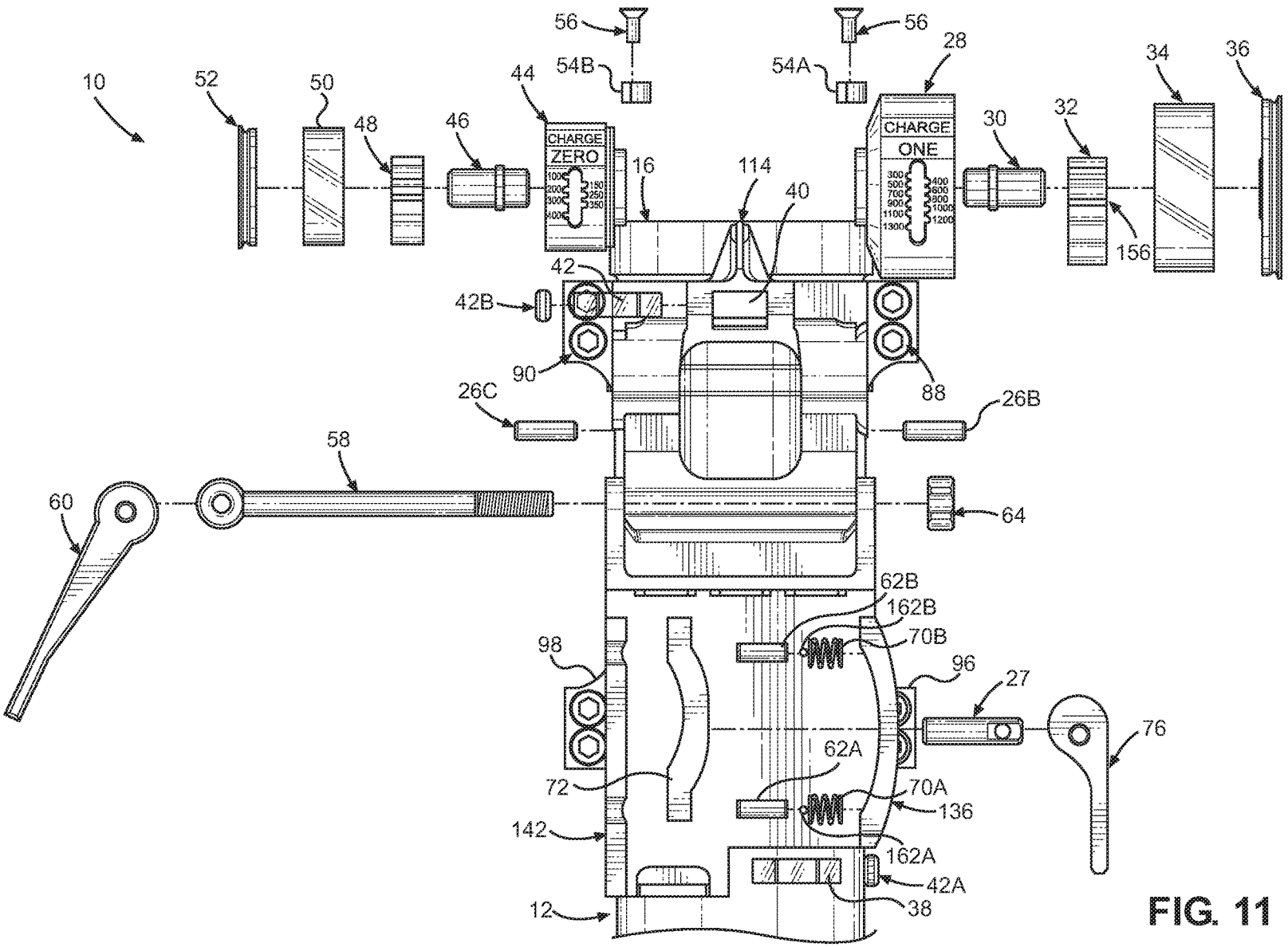
FIG. 11 is a top exploded view of the sighting system for use with a lightweight mortar.

Referring now to FIGS. 9, 10 and 11, exploded views of an embodiment of the removable sighting device 10 for use with a mortar during hand firing operations are shown. A compass cam lever 76 assembly includes biasing elements which are coil compression springs 70A, 70B including plungers 162A, 162B, respectively, as best shown in FIG. 11, so shock as a result of recoil of the mortar tube 12 when a round is fired and which may otherwise be transmitted to the sighting device may be absorbed in part by the helically wound compression springs. A clamp formed as a compass capture plate 72 is provided with a curved geometry to accommodate, secure and retain the compass 118 therebetween the compass capture plate 72 and the curved sidewall distal extension 136 of compass housing 126. Coil spring biasing elements 70A, 70B and plungers 162A, 162B bear against aligned dowel pins 62A, 62B which thereby extend through co-axially aligned capture plate apertures 92 to thereby force capture plate 72 to exert a clamping force against compass plate 66 to thereby securely retain compass 118 in housing 126, thus allowing the compass assembly to be quickly installed, released or locked in place in the compass housing 126 without the use of tools.

As depicted in FIGS. 9, 10 and 11, the removable sighting device 10 is connected to the mortar tube 12. The upper carrier plate portion 20 of the mortar collar 80 attachment assembly is attached to the bottom portion 22 of the mortar collar 80 attachment by mechanical fasteners such as cap screws 24*a-h*.

The Charge One distance indicator wheel 148 includes a charge one distance dial 28 which includes a dial pin 30 forming an axle on which a charge one distance indicator 32 is placed. A charge one clear, i.e. transparent insert 34 is placed inside the charge one distance dial 28 to prevent moisture, dust or dirt from entering the charge one distance dial 28. A charge one dial cap 36 is placed over the end portion of the charge one distance dial 28. The exterior surface of the charge one distance dial 28 includes and displays indicia indicating the distance a mortar projectile with a charge of one would travel. The distance is shown by the position of the charge one distance indicator 32 as it is viewed through the transparent window formed by the charge one clear insert 34.

The Charge Zero distance indicator wheel 146 includes a charge zero distance dial 44 which includes a dial pin 46 forming an axle on which a charge zero distance indicator 48 is placed. A charge zero clear insert 50 is placed inside the charge zero distance dial 44 to prevent moisture, dust or dirt from entering the charge zero distance dial 44. A charge zero dial cap 52 is placed over the end portion of the charge zero distance dial 44. The exterior of the charge zero distance dial 44 includes indicia indicating the distance a mortar round or projectile with zero added charge would travel. The distance is shown by the position of the charge zero distance indicator 48 as it is viewed through the window formed by the charge zero clear insert 50.

Each wheel 146, 148 is formed with a fixed reference mark in the form of a pointer 152, 156, respectively, such that as a wheel rotates its reference mark or pointer aligns itself with a distance indicium for any vertical tilt at which the mortar tube 12 is positioned.

Advantageously, as the tube 12 is aimed up or down, for any vertical angle at which the tube is positioned, the indicator wheels 146, 148 and associated dials 28, 44 are calibrated to the cosine corresponding to that angle; the cosine function is directly translated to a horizontal distance to target and displayed on the wheel in a range gradient expressed in meter increments to the mortarman. Generally, a mortarman would have to measure the vertical angle between his mortar and his target by means of a protractor, calculate the cosine of the angle, and multiply the straight-line distance by the cosine to obtain the horizontal distance to target. This is time consuming and requires a mortarman to perform accurate trigonometric calculations before firing when time is of the essence.

Advantageously, the dials 146, 148 of the claimed invention are adapted and arranged to flank the hub 78 and thus are visible and readable within the field of view of the mortarman and without requiring the mortarman to take his eyes off of the target area or remove his focus from the sight picture created by the front sight blade 114 and rear compass sight blade 116 aligned with direction to target area, thereby further enabling the mortarman to quickly and accurately engage the target.

In a preferred embodiment, indicia 150, 154 and pointers 152, 156 and front sight blade 114 comprise tritium or may be coated with tritium (H3) to thereby facilitate the use of the sight during night firing or firing in low light levels. Tritium is luminescent thereby allowing the indicia and pointers to be readily visible and read by a mortarman at night, in the dark and in low-light conditions. The term "luminescent" is used in a functional sense indicating a self-luminescent, self-illuminating or self-activated luminescent material or composition that does not require charging, photo-charging or exposure to a light source to trigger luminance. Other materials are available that would be suitable for alternative embodiments of the subject matter of the present disclosure. Examples include promethium (P or Pm) or any other similar luminescent materials or compositions. Those in the art will understand that any suitable material, now known or hereafter developed, may be used in forming the indicia described herein. Photoluminescent pigment materials, compositions or any other similar materials having or providing luminescence or luminance are also contemplated within the scope of the subject matter of the present disclosure. In less preferred embodiments the sight device indicia, pointers and blade may be illuminated with a light source, for example a flashlight, battery operated LEDs, an instrument light, instrument panel lights or a light source that generates a light beam to provide sighting means for night firing. Those of skill in the art will understand that a number of variations may be made in the disclosed embodiments, all without departing from the scope of the inventions, which is defined solely by the appended claims.

As shown in FIG. 10, Bottom portion 22 mounting rings 22A, 22B are formed with eyes or loops such as sling loops 160A, 160B thereby allowing a quick, convenient and sturdy attachment structure for locating and attaching hooks, carrying slings, straps, handles and webbing thereby allowing a mortarman to carry the handheld mortar slung over a shoulder or across a torso in a hands-free, convenient manner. The loops, slings and attachment means may be fabricated of sound dampening, sound absorbing, or sound proofing materials that prevent clanging noises that might otherwise betray the mortarman's position as he carries the mortar tube. The mounting rings may be fabricated of materials further including, encased by, or installed with heat shielding materials to prevent the mortarman's hands from being burned or seared by the increased temperatures generated as the mortar tube is fired.

As shown in FIGS. 4, 5, 8 and 10, rail structures such as Picatinny rails 102, 104 are provided affixed on a lowermost portion of mount rings 22A, 22B. The rail base is an elongated structure defining upwardly extending rail projections 158A, 158B with evenly spaced transverse slots between them to provide for selective location and attachment of an accessory on the rail. In a preferred embodiment, each mount ring 22A, 22B may carry a rail. In alternative embodiments an elongated rail structure may extend and be affixed between and to both rings 22A, 22B to provide a unitary lower portion 22.

The rail 102, 104 structures 158A, 158B are formed with a flat mounting surface and opposite transverse edges beveled to form a dove tail cross sectional profile with oppositely angulated mounting surfaces and oppositely angulated lower mounting surfaces. Both upper and lower mounting surfaces are oriented at approximately 45 degree angles with respect to the horizontal plane of the top surface mounting surface, thereby allowing the mortarman to add attachments and weapon-mounted accessories.

By adding sighting devices and directional information by adding a compass and distance dials which allow one to determine the distance the mortar bomb would travel with no charge or a single charge, the speed and accuracy of delivering indirect fire on target by the handheld mortar can be markedly increased.

Using this type of sight enables the mortarman to rapidly and properly position the mortar and be certain of his intended target. This enables accurate rounds to be placed on target quickly.

Definitions: By handheld mortar use we are describing the use of a light mortar, about 60 mm or less, without the use of a conventional bipod or tripod. By handheld mode we are describing aiming or re-aiming a mortar tube, launcher, and/or weapon barrel whether or not supported on the ground, manually, or with or without the aid of mechanical or electronic drive means or actuating means. The compass declination, magnetic declination, or declination, that is, the bearing or angle relative to magnetic north, for purposes of this patent will be known as the azimuth.

Although the embodiments of the mounting rings as described herein may be provided by other fasteners, in other embodiments they may take other mechanical forms. By way of non-limiting example, cams and levers may be adapted to provide clamping forces. It is contemplated that such cams, levers and other devices be arranged in a "quick release" mechanism to allow the rings and mounts to be quickly and easily attached and released without the use of tools, while still providing the necessary clamping force to securely retain the sighting assembly within the mounting rings. The use of such quick release mechanisms may be incorporated and adapted to the attachment assembly mounting mechanism within the teachings of this invention.

The components of the sighting apparatus may be fabricated from any suitable durable, non-brittle, material, including formed, pressed, forged, cast and/or machined metal such as stainless steel or aluminum, to the extent that they do not interfere with the operation of the compass. These materials are readily available and those in the art are familiar with working with such material. Other materials are available that would be suitable for alternative embodiments of the subject matter of the disclosure. Examples include, but are not limited to, metallic materials such as titanium, metal composites or alloy, high-density polymers, carbon fiber, resin, plastic, thermoplastics, thermoplastic elastomers, nylon, rubber materials, any combination thereof, or any other materials that provide uniform strength and stress distribution throughout the structure. The components of the mounting structure may fabricated, cast, or 3D printed from any suitable durable, non-brittle, resilient, or elastomeric materials that can withstand impact and shock as a result of recoil of the mortar tube when rounds are fired, the temperature rise of the tube generated during repeated rapid firings of the tube, exposure to extreme environmental and weather conditions, and dust, sand, rain, frost, and other elements and climate conditions encountered during demanding infantry operations. The selection of suitable materials based on known properties of specific weight, durability, toughness and strength would be within the ability of a person skilled in the art. Those in the art will understand that any suitable material, now known or hereinafter developed, may be used in forming the portions described herein. Those of skill in the art will understand that a number of variations may be made in the disclosed embodiments, all without departing from the scope of the invention, which is defined solely by the appended claims.

To recap, the claimed invention comprises a sighting system for firing a mortar in handheld mode, including a muzzle-mounted attachment assembly adapted to be affixed to a distal, discharge end of a mortar tube; a hub a mounting bracket assembly; a horizontal angle indicator assembly and a vertical angle indicator assembly adapted and arranged to flank the horizontal angle indicator assembly such that a mortarman can read the vertical angle indicator directly without having to take his focus off of the direction to target or look vertically downward toward a handle or base end of the mortar tube; and further including a mounting bracket and sighting assembly for a mortar, including: a compass housing, cam actuated, an attachment for the compass housing to the top of the mounting bracket, cam actuated, the mounting bracket having a top side and a bottom side strap, the top side of the mounting bracket is connected to the bottom side of the mounting bracket by fasteners. By virtue of this arrangement, elevation adjustment of the sight is simply and easily accomplished and the angular setting of the sight can be read from a large distance range and charge scale visible on the discharge end of the mortar tube. By virtue of a wheel rotating casing arrangement, the elevation angle of the mortar tube and sight can be more rapidly and accurately adjusted to achieve a range distance zoning to target.

Although the present invention has been described in considerable detail with reference to certain preferred versions thereof, other versions are possible. Therefore, the spirit and scope of the appended claims should not be limited to the description of the preferred or exemplary embodiments herein. A substantive encapsulation of the invention has been provided using specific terms and drawings. Such illustrations are for representative purposes only and are not intended to capture all iterations and variations of the invention.

It will be appreciated that the above description relates to a specific embodiment of the invention, provided by way of example only. A number of variations are possible, and would be obvious to those of ordinary skill in the art. Such obvious variations are within the scope of the invention as defined and claimed, whether or not expressly recited. Although specific arrangements are shown in the exemplary embodiment, any suitable structures, attachments or mechanisms can be employed to perform the function recited herein; neither the present disclosure nor the appended claims are limited to the specific arrangements or embodiments shown in the Drawings. It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions, additions, or substitutions of equivalents are contemplated as circumstances may suggest or render expedient without departing from the scope of the disclosure, but is intended to cover the application or implementation without departing from the spirit or scope of the claims of the present invention. The terms "including" and "having" as used in the specification and claims shall have the same meaning as the term "comprising."

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

We claim:

1. A sighting system affixed to a discharge end of a mortar comprising:

a hub;

a mounting bracket assembly;

a horizontal angle indicator assembly;

a vertical angle indicator assembly adapted to flank said horizontal angle indicator assembly;

wherein a horizontal angle indicator is received in a housing, said housing includes a cam lever securing mechanism attached to a clamping plate, such that when said cam lever securing mechanism is activated, said clamping plate moves and secures said horizontal angle indicator intermediate to said clamping plate and a linear sidewalk;

wherein said housing includes an integral depending hub bracket comprised of a first element and a second element, said first element and said second element each include an aperture, said apertures are further co-linear and are secured to a raised hub portion which includes a horizontal aperture there through; and wherein a hub cam lever is connected to a cam bolt which passes through said first element aperture, said horizontal aperture, and said second element aperture, allowing said housing to pivot about said cam bolt, and further permitting said housing to be locked in position by engaging said hub cam lever.

2. A sight for a mortar to be fired in hand held firing mode comprising:

a collar which is attached proximal to the discharge end of the mortar, said collar including:

a U-shaped hub, said U-shaped hub attached to a top side of said collar, said U-shaped hub having a central raised portion with an aperture there through, said U-shaped hub further includes a first indent on a first outer side and a second indent on a second outer side;

a housing with an extended bracket, said extended bracket connected to said central raised portion by a hinge bolt attached to a first cam lever;

a charge one dial having a first dovetail and a charge zero dial having a second dovetail; and whereby said charge one dial said first dovetail engages said first indent and said charge zero dial said second dovetail engages said second indent, and said housing can pivot about said hinge bolt when said first cam lever is released and said housing is locked in place when said first cam lever is secured.

3. A sight for a mortar to be fired in hand held firing mode as claimed in claim 2, wherein said housing includes:

a bottom plate;

a first arcuate sidewall;

a second movable arcuate sidewall;

a first linear sidewall;

a first top side sidewall; and a second cam lever connected to a pair of spring biased pusher rods, said pair of spring biased pusher rods are located intermediate to said first arcuate sidewall and said second movable arcuate sidewall, whereby said housing receives a compass therein when said second cam lever is released and further said second movable arcuate sidewall moves towards and captures the compass in said housing when said second cam lever is engaged, thus securing the compass in said housing.

4. A sight for a mortar to be fired in hand held firing mode as claimed in claim 3, wherein a first bubble level is affixed to an exterior side of said first top side sidewall.

5. A sight for a mortar to be fired in hand held firing mode as claimed in claim 4, wherein said charge one dial includes a pointer which points to indicia indicating a distance a charge one mortar projectile will travel given a specific angle of the mortar.

6. A sight for a mortar to be fired in hand held firing mode as claimed in claim 5, wherein said charge zero dial includes a pointer which points to indicia indicating a distance a charge zero mortar projectile will travel given a specific angle of the mortar.

7. A sighting system for a mortar attached proximal to a discharge end of a mortar tube to be deployed and fired in hand held firing mode comprising:

a mortar tube attachment device including a top half portion and a front mount ring and a rear mount ring;

said top half portion is mechanically attached to said front mount ring and said top half portion is mechanically attached to said rear mount ring;

said top half portion including a hub;

said hub including a front element and a rear element, said front element further includes a first side and a second side;

said first side includes a charge one range dial for a charge one mortar projectile, said second side includes a charge zero range dial for a charge zero mortar projectile;

said hub rear element includes a centrally disposed transverse aperture which extends from said first side to said second side;

a compass support plate further including a compass housing, said compass housing including a bracket with a first leg and a second leg, said first leg including a first aperture, said second leg including a second aperture, said first leg said first aperture and said second leg said second aperture aligned with said centrally disposed transverse aperture on said hub rear element;

where said compass support plate is secured to said hub rear element by a first cam bolt which passes through said first leg first aperture, through said centrally disposed transverse aperture and said second leg second aperture, said first cam bolt fastened atop said second aperture and said first cam bolt mated with a first cam lever proximal said first leg first aperture;

a compass with a pivotable compass cover, the compass secured in said compass housing atop said compass support plate, said compass support plate pivotable about said first cam bolt in said hub; and whereby a mortarman may sight a mortar in hand held mode having both distance and azimuth information in plain view of a line of sight to a target.

8. A sighting system for a mortar attached proximal to a discharge end of a mortar tube to be deployed and fired in hand held firing mode as claimed in claim 7, wherein said compass housing includes a left linear sidewall and a right cam biased curved sidewall.

9. A sighting system for a mortar attached proximal to a discharge end of a mortar tube to be deployed and fired in hand held firing mode as claimed in claim 8, wherein said right cam biased curved sidewall is connected to a compass clamping plate by a pair of dowel pins, each of said dowel pins having a pair of co-axially mounted springs, and further said right cam biased curved sidewall is connected to a second cam lever whereby when the compass is placed in said compass housing and said second cam lever is actuated, said compass clamping plate is urged against the compass which in turn secures the compass in an intermediate position between said right cam biased curved sidewall and said left linear sidewall.

10. A sighting system for a mortar attached proximal to a discharge end of a mortar tube to be deployed and fired in hand held firing mode as claimed in claim 9, wherein said charge one range dial includes a first set of indicia and a first pointer, said first pointer moves with an angle of the mortar and points out a distance the charge one projectile will travel on said first set of indicia, said first set of indicia and said first pointer are coated with tritium for accurate readings in darkness.

11. A sighting system for a mortar attached proximal to the discharge end of a mortar tube to be deployed and fired in hand held firing mode as claimed in claim 9, wherein said charge zero range dial includes a second set of indicia and a second pointer, said second pointer moves with an angle of the mortar and points out a distance the charge zero projectile will travel on said second set of indicia, said second set of indicia and said second pointer are coated with tritium for accurate readings in darkness.

* * * * *